US005356125A

United States Patent [19]

Hansch et al.

[11] Patent Number: 5,356,125

[45] Date of Patent: Oct. 18, 1994

[54] APPARATUS FOR STAPLING FOLDED PRINTED SHEETS

[75] Inventors: Egon Hansch, Wetzikon; Willy Leu, Pfaffikon, both of Switzerland

[73] Assignee: Ferag AG, Hinwil, Switzerland

[21] Appl. No.: 905,169

[22] Filed: Jun. 24, 1992

Related U.S. Application Data

[63] Continuation of Ser. No. 732,656, Jul. 19, 1991, abandoned, which is a continuation of Ser. No. 527,749, May 23, 1990, abandoned.

[30] Foreign Application Priority Data

May 25, 1989 [CH] Switzerland ..... 01964/89-3

[51] Int. Cl.[5] ..... B42B 2/00; B27F 7/17; B25C 5/04

[52] U.S. Cl. ..... 270/53; 227/81; 227/82

[58] Field of Search ..... 270/37, 53, 54, 55, 270/56, 57, 58, 52; 227/81, 82, 83

[56] References Cited

U.S. PATENT DOCUMENTS

| | | | |
|---|---|---|---|
| 1,711,960 | 5/1929 | Morris . | |
| 2,709,808 | 6/1955 | Murrell et al. . | |
| 2,722,000 | 11/1955 | Turrall | 227/81 |
| 2,966,681 | 1/1961 | Campell | 1/44.4 |
| 3,763,799 | 10/1973 | Bottcher | 227/81 X |
| 3,915,445 | 10/1975 | Duncan et al. . | |
| 4,157,821 | 6/1979 | Fabrig | 270/53 |
| 4,196,835 | 4/1980 | Schlough | 227/81 |
| 4,236,706 | 12/1980 | Schlough | 270/53 |
| 4,315,588 | 2/1982 | Faltin | 227/81 |
| 4,408,755 | 10/1983 | Meier | 270/55 |
| 4,478,398 | 10/1984 | Stobb | 270/53 |
| 4,489,930 | 12/1984 | Meier | 270/55 |
| 4,519,599 | 5/1985 | Mayer | 270/53 |
| 4,614,290 | 9/1986 | Boss | 227/1 |
| 4,641,825 | 2/1987 | Mowry et al. | 270/53 |
| 4,650,174 | 3/1987 | Stobb | 270/53 |
| 4,708,277 | 11/1987 | Schlough | 227/82 X |
| 4,735,406 | 4/1988 | Brittman | 270/53 |
| 4,750,661 | 6/1988 | Pane | 227/7 |
| 4,792,077 | 12/1988 | Faltin | 227/81 |
| 4,840,364 | 6/1989 | Schneider . | |
| 4,892,297 | 1/1990 | Kobler . | |
| 5,137,409 | 8/1992 | Honegger | 270/53 |

FOREIGN PATENT DOCUMENTS

| | | |
|---|---|---|
| 459145 | 7/1968 | Switzerland . |
| 740079 | 11/1955 | United Kingdom . |
| 2029464A | 3/1980 | United Kingdom . |
| 2176174A | 12/1986 | United Kingdom . |

*Primary Examiner*—Edward K. Look
*Assistant Examiner*—John Ryznic
*Attorney, Agent, or Firm*—Willian Brinks Hofer Gilson & Lione

[57] ABSTRACT

A process and apparatus for collecting and stapling printed products is provided. A self-enclosed track of travel for stapling heads extends around a collector drum having a plurality of supports. A stapling head is assigned to each support. The stapling heads rotate mutually synchronously about the axis of rotation of the drum. While running past a wire section dispenser, each stapling head accepts a wire section from which a staple is formed in a predetermined first region. In a second region, the staple is brought onto the side of the stapling heads facing the supports. In a third region, the staple is brought onto the side of the stapling heads facing the supports. In a third region, the stapling heads are lowered onto the printed sheets, which are deposited onto the supports, and stapled together.

12 Claims, 17 Drawing Sheets

APPARATUS FOR STAPLING FOLDED PRINTED SHEETS

This application is a continuation of application Ser. No. 07/732,656, filed Jul. 19, 1991, now abandoned which is a continuation of application Ser. No. 07/527,749, filed May 23, 1990 now abandoned.

BACKGROUND OF THE INVENTION

The present invention relates to a process and an apparatus for collecting and stapling folded printed sheets of the type having a plurality of supports which travel along a closed path of conveyance, on which supports printed sheets can be deposited astride one another and a stapling station for placing staples onto the printed sheets on the supports.

Such an apparatus is known, for example, from DE-OS 3,616,566, or from the corresponding U.S. Pat. No. 4,735,406. This disclosed apparatus has a collector drum with saddle-shaped supports that are arranged parallel to a common axis of rotation and are driven to rotate about this axis. Provided in the direction of the axis of rotation are two feeders which follow one another and deposit folded printed sheets onto the supports. A stapling station follows the feeders for stapling together the mutually overlying printed sheets. Immediately after stapling, the collected and stapled printed sheets are deposited onto a conveyor belt which transports the stapled printed sheets away. The stapling station has a plurality of stapling head pairs, which are arranged at the spacing of the supports, which extend parallel to one another, on a bail that is swivelably mounted on the axis of rotation of the drum. The bail is moved to and from by means of a swivel drive with the stapling heads simultaneously placing one staple each into the printed sheets during the synchronous operation with the supports.

As to the construction of the stapling heads, these above-referenced printed publications refer to CH Patent Specification 549,443 or U.S. Pat. No. 4,614,290. These known stapling heads are each fed a wire from which a wire section is severed in each case by means of a cutting device arranged on the stapling head. This wire section is bent around a matrix by means of a slidably mounted stamp to form a staple. The staple is forced out of the stamp by means of a slidably mounted ram and inserted into the printed sheets. This known apparatus has the disadvantage that the stapling station must have a complicated drive which must apply large accelerating forces, especially in the case of a high processing rate. Moreover, during each operational cycle of the stapling station, the movement of the stapling heads must be exactly synchronized with the supports. Since a wire has to be fed to each stapling head, in the case of moving stapling heads this synchronization is complicated both for the feeding of the wire and for the stapling heads themselves.

A stapling station for stapling together printed sheets carried by a rotating cylinder is described in EP-A 0,205,144 and corresponding U.S. Pat. No. 4,750,661. Three stapling heads are arranged next to one another in each case at the free ends of a cruciform holding device. The holding device is driven to rotate opposite to the direction of rotation of the cylinder about a shaft parallel to the axis of the cylinder. The three stapling heads run past three wire section dispensers common to all corresponding stapling heads. The circular track of travel of the stapling heads is tangent to the surface of the cylinder. The rotary motion of the holding device is synchronized with the cylinder in such a way that the printed sheets to be stapled to one another always meet the stapling heads. In this known stapling station, only an exceptionally short time is available in each case for placing the staples. This renders reliable, good quality stapling difficult in the case of high processing rates.

Furthermore, an apparatus for collecting folded printed sheets is known from CH Patent Specification 645,074 and corresponding U.S. Pat. No. 4,408,755. This apparatus likewise has a drum with supports extending parallel to a common axis of rotation. The folded printed sheets are deposited one above the other, mutually associated to form zigzag volumes, on the supports. By means of a stapling station (not described in more detail), staples are placed in the volumes which are laid one above the other and supported by the supports.

Therefore, it is an object of the present invention to create a process according to the generic type described above for collecting folded printed sheets, and to provide a corresponding stapling apparatus in which the stapling station has a high processing capacity yet has simply constructed stapling heads and a relatively uncomplicated drive.

SUMMARY OF THE INVENTION

To achieve these objects, an apparatus for collecting folded printed sheets is provided which comprises a plurality of spaced saddle-shaped supports including means for arranging the supports to rotate along a closed path of conveyance. In at least one section of the path of conveyance, the supports have a mutually parallel longitudinal extent which extends substantially perpendicular to the direction of rotation. At least two feed stations are arranged spatially from one another for depositing printed sheets astride one another on the supports. A stapling station is arranged at the at least one section of the path of conveyance, downstream of the feed stations. The stapling stations have at least one stapling head arrangement which includes a plurality of stapling heads for placing staples into the printed sheets which are deposited on the supports. Means are provided for forming staples from essentially straight wire sections which are held by the stapling heads. The stapling heads are arranged one behind another essentially at the spacing of the supports and move in a plane which extends transverse to the supports. During stapling, the stapling heads move synchronously with the supports. The stapling heads rotate along a closed track of travel with the track of travel leading past a wire section dispenser. The stapling heads rotating at a rate or velocity essentially equal to the rate or velocity of the supports and, in a first region of the track of travel, the stapling heads move with the supports along the at least one section of the path of conveyance of the supports. A lead-away station conveys the stapled printed sheets away.

Since the stapling heads are essentially arranged behind one another with a spacing corresponding to the spacing of the supports and rotate along a closed track of travel at essentially the same rate as the supports, large accelerating forces are avoided for the rotation of the stapling heads in the stapling station.

This arrangement in conjunction with the direction of rotation of the stapling heads, which always remains the same, enables a simple drive. The closed track of travel of the stapling heads leads past a common wire section dispenser for the stapling heads. An individual wire section dispenser thus supplies all stapling heads of a stapling head arrangement. This keeps the apparatuses which provide the wire sections extremely modest. Moreover this arrangement enables a simple construction of the stapling heads, since the stapling heads themselves no longer need to have any cutting device.

The spacing between the stapling heads along the track of travel is large enough that, during placing of the staples, the distance between the staples corresponds in each case to the spacing of the supports. Thus, depending upon the course of travel of the track, during placing of the staples, the mutual spacing of the stapling heads can be slightly different in relation to the spacing of the supports.

In a particularly preferred embodiment, the apparatus according to the invention has an extremely simple drive for the stapling heads. In this embodiment, supports of a collector drum rotate about a common axis of rotation and extend essentially in the horizontal direction. A holding arrangement embraces the collector drum and is constructed in an annular shape. The holding arrangement is pivotally mounted on a frame and one stapling head per support is arranged on the holding arrangement.

BRIEF DESCRIPTION OF THE DRAWINGS

The invention will now be explained in more detail with reference to the drawing, wherein in strictly diagrammatic form.

DETAILED DESCRIPTION OF THE PRESENTLY PREFERRED EMBODIMENTS

Figure 1:
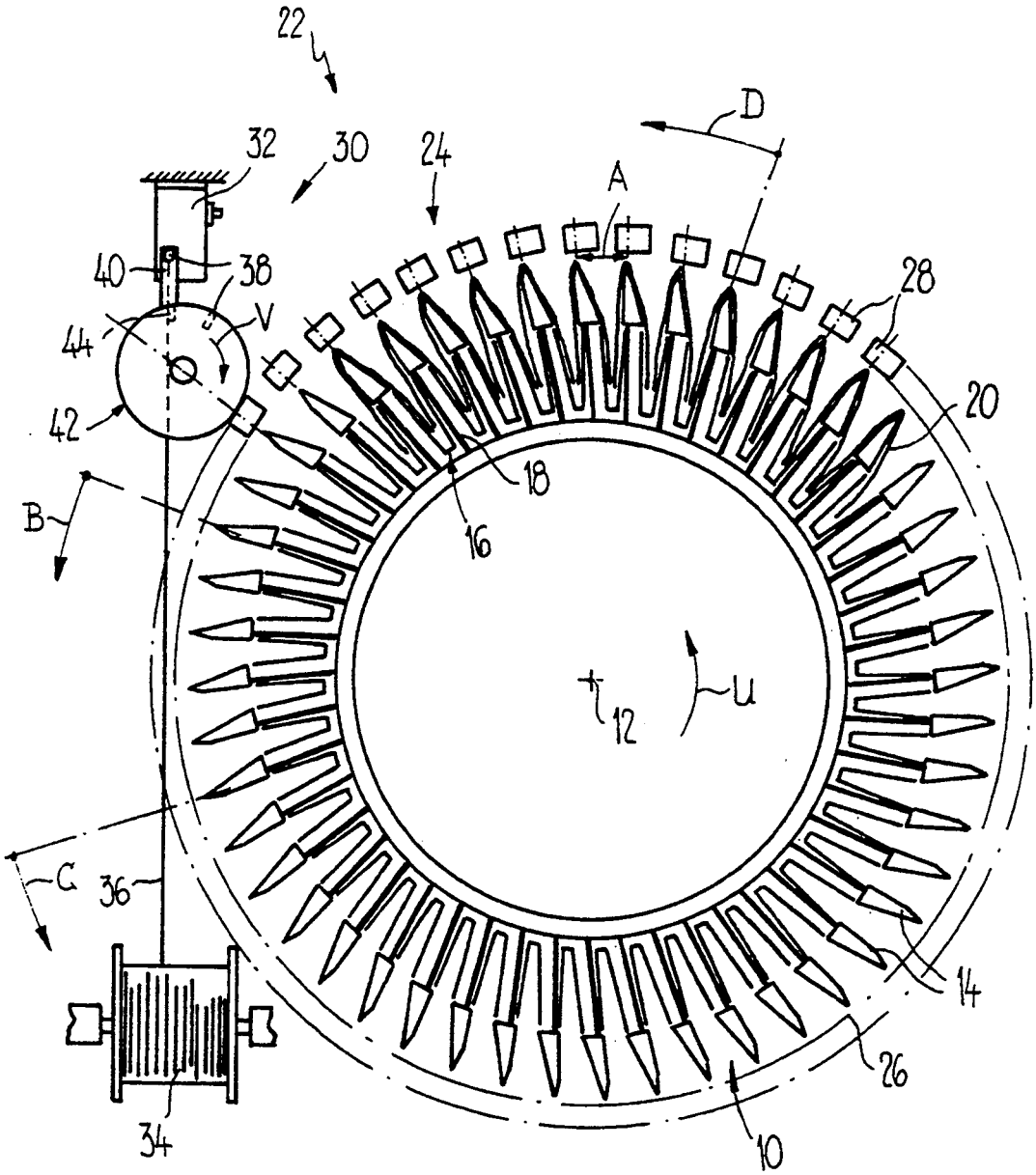
FIG. 1 shows a preferred embodiment of the invention which includes a collector drum having a stapling station of which the stapling heads rotate along a track of travel guided around the collector drum.

FIG. 1 shows a collector drum 10 such as is described in detail in EP Patent Application 89,106,113.7 or the corresponding U.S. patent application Ser. No. 07/349,303. This collector drum 10 has saddle-shaped supports 14 which are arranged around a common axis of rotation 12, extend in the direction of the axis of rotation 12, and are driven in the direction of rotation U. A carriage 16 is arranged such that it can be moved back and forth in the direction of the axis of rotation 12. The carriage 16 is provided in the region between two neighboring supports 14 in each case with a controllable clamping arrangement 18 for the folded printed sheets 20 which are deposited astride the supports 14.

A stapling station 22 has a stapling head arrangement 24 with stapling heads 28 which are arranged essentially behind one another along a track of travel 26 which extends coaxially around the collector drum 10. Each support 14 is assigned a stapling head 28 and, therefore, the stapling heads 28 are essentially arranged with the same mutual spacing A as the supports 14.

Provided outside the track of travel 26 is a wire section dispenser, designated by 30, past which the track of travel 26 leads. This wire section dispenser 30 has a cutting device 32 by means of which wire sections 38 are severed from a wire 36 drawn from a supply roll 34. Downstream of the cutting device 32 is a magazine 40 that is fed by the cutting device 32 with wire sections 38. A conveyor wheel 42 includes holding elements 44 distributed along the circumference of the conveyor wheel 44. The conveyor wheel 42, driven in the direction of rotation V, draws a wire section 38 from the magazine 40 in each case by means of its holding elements 44 and conveys the wire section 38 to the stapling heads 28.

The apparatus represented in FIG. 1 operates as follows. Seen in the direction of conveyance of the carriage 16, feed stations for printed sheets are located in a known way upstream of the stapling station 22. In each case, these feed stations deposit a folded printed sheet 20 astride each support 14, which runs past the feed station in the direction of rotation U. In each case, before a support 14 enters the lower region of its circular track of travel, the relevant clamping arrangement 18 is clamped in place in order to retain the parts of the printed sheets 20 reaching into the appropriate carriage 16. As the carriages 16 pass through the lower half of the track of travel of the supports 14, they execute a working stroke in the longitudinal direction of the axis of rotation 12 to the nearest feed station or to the stapling station 22. Upon leaving the lower half of the track of travel of the supports 14, the relevant clamping arrangement 18 is once again released, so that the printed sheets 20 in the upper region of the rotation track of the supports 14 experience no movement in the direction of the axis of rotation 12. In this region of the track of travel, the carriages 16 execute a return stroke with the opened clamping arrangement 18.

The stapling heads 28 are likewise driven synchronously with the supports 14 in the direction of rotation U. When a stapling head 28 runs past the conveyor wheel 42, the stapling head 28 accepts a wire section 38 from the conveyor wheel 42. In a region that is designated by B and, seen in the direction of rotation U, follows the wire section dispenser 30, the wire section 38 now held by the stapling head 28 is formed into a staple, as is described in detail below. In a subsequent region of the track of travel 26 that is designated by C, the staple is brought from the outer side of the stapling heads 28, seen in the radial direction, to the inner side facing the supports 14. A region D of the track of travel 26 of the stapling heads 28 is located in the upper half of the rotation track of the supports 14 in which the printed sheets 20 execute no movement in the direction of the axis of rotation 12. In this region D, the relevant stapling heads 28 are lowered onto the printed sheets 20 which are deposited one above the other on the supports 14 and the staples are inserted into the printed sheets. In this process, the spacing A of the stapling heads 28 corresponds to the spacing of the support 14. After the staples are placed, the stapling heads 28 are raised once again, whereupon the collected and stapled printed sheets 20 are now fed, in the course of the next rotation of the collector drum 10 in the direction of the axis of rotation 12, to a lead-away station.

Figure 2:
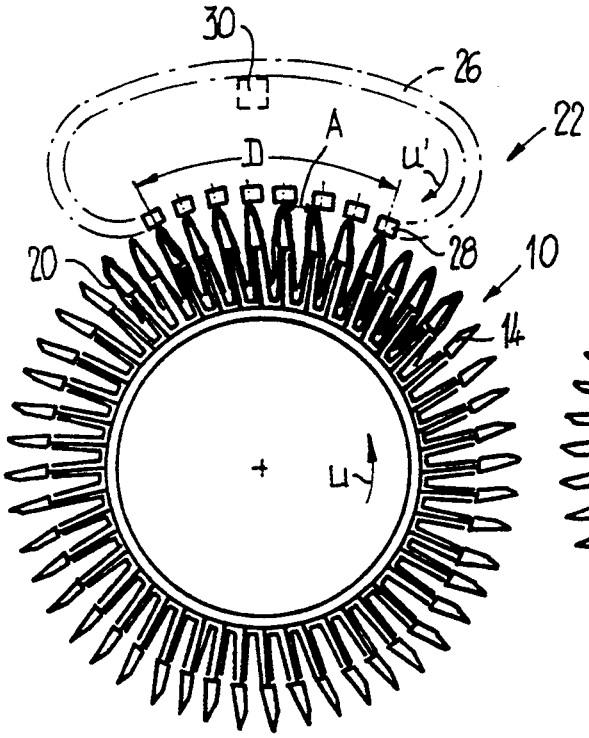
FIGS. 2 and 3 show the same collector drum as in FIG. 1, but with the stapling heads rotating along a kidney-shaped or circular track of travel.
Figure 3:
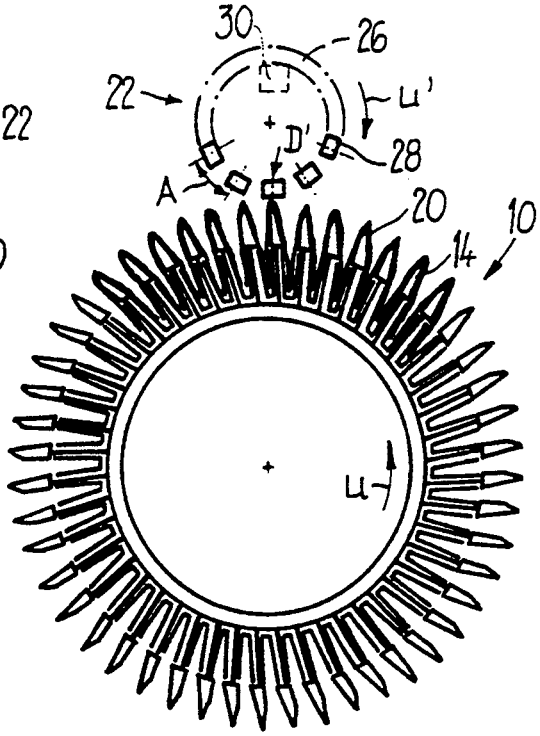

The collector drum 10 shown in FIGS. 2 and 3 corresponds to that of FIG. 1, and will therefore not be described in more detail. According to FIG. 2, the track of travel 26 for the stapling heads 28 is constructed in the form of a kidney and runs in a region D along the rotation track of the supports 14 of the collector drum 10. The collector drum 10 is arranged outside the track of travel 26. The wire section dispenser 30, which is indicated only diagrammatically, is arranged inside said track. The collector drum 10 rotates in the counterclockwise direction U, and the stapling heads 28 are driven in the opposite direction U' at the same rate as that of the supports 14. During placing of the staples, the spacing A of the stapling heads 28 corresponds in turn to the spacing of the supports 14, so that in each case a corresponding stapling head 28 runs along with each support in the region D for placing the staples.

The embodiment shown in FIG. 3 corresponds essentially to that of FIG. 2. The only difference consists in that the track of travel 26 is constructed in the form of a circle, and the region D is consequently essentially shortened to a point D'. This means that the particular stapling head 28 comes to bear only very briefly for placing the staple into the printed sheets 20 deposited onto the supports 14. Here, too, the stapling heads 28 are arranged along their track of travel 26 at a spacing A that corresponds, during placing of the staples, to the spacing of the supports 14 of the collector drum 10.

Figure 4:
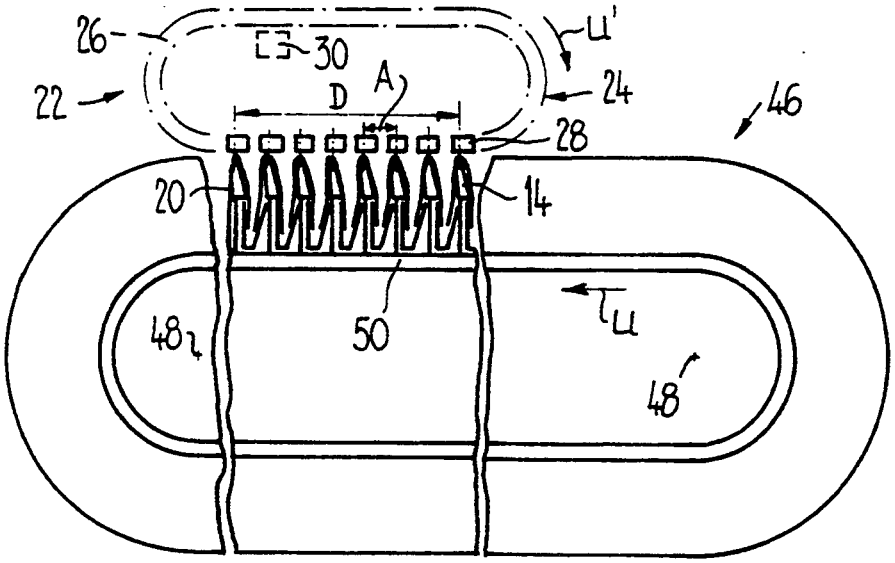
FIG. 4 shows a collector device with an elongated rotation track for the supports, and a likewise elongated track of travel for the stapling heads.

The embodiment of the apparatus represented in FIG. 4 for collecting folded printed sheets 20 has a collector conveyor 46 such as is described in the EP Patent Application 89,106,108.7 or in the corresponding U.S. patent application Ser. No. 07/365,616 or with a similar construction in EP Patent Specification 0,095,603 or corresponding U.S. Pat. No. 4,489,930. The collector conveyor 46 has a tension element 50, which is led around two mutually spaced deflecting wheels. The wheels are merely indicated in the drawing with their axes of rotation 48 which extend essentially horizontally. The tension element supports 14 are arranged on the tension element 50 at specific spacings behind one another and extending parallel to one another and perpendicular to the direction of rotation U. The stapling station 22 has a stapling head arrangement 24, arranged above the collector conveyor 46. The stapling station 22 includes an elongated track of travel 26 for the stapling heads 28. The stapling heads 28 are arranged on a tension member (not riveted) at the same spacings A as the supports 14 in the region D. The tension member is driven in the direction U' at the same rate as the tension element 50 in the direction U. Consequently, the stapling heads 28 extend synchronously with the supports 14, and each move past the wire section dispenser 30 remote from the region D. Feed stations for laying folded printed sheets 20 onto the supports 14 are located in a known manner upstream, seen in the direction of the arrow U, of the stapling station 22 along the upper side of the collector conveyor 46. Of course, a lead-away station for the stapled printed sheets 20 is located downstream of the stapling station 22.

The stapling stations 22 represented in FIGS. 2 to 4 function as follows. On each occasion, each stapling head 28 accepts a wire section from the wire section dispenser 30 as it runs past it. In the course of the rotational movement in the direction of the arrow U' along the track of travel 26, a staple is bent from the wire section in the region between the wire section dispenser 30 and the region D, D' (staple placing region), the staple is brought onto the side of the stapling heads 28 that is located outside in relative to the track of travel 26. In the region D, D', the stapling heads 28 come to bear on the relevant supports 14 or on the printed sheets 20 deposited thereupon, and place the staple into the printed sheets 20.

In embodiments according to FIGS. 2 and 4, it is also conceivable to arrange the wire section dispenser outside the track of travel 26. Of course, in this case the wire section or the staple remains on the side of the stapling head that is located outside relative to the track of travel.

An embodiment of the invention according to FIG. 1 is now described below in more detail. The stapling station 22 shown in FIGS. 5 and 6 has two stapling head arrangements 24 arranged on the same holding arrangement 52. The holding arrangement 52 is constructed with an annular shape and coaxially embraces the collector drum 10, which is driven about the axis of rotation 12 in the direction of rotation U. The holding arrangement 52 has two holding rings 54, which are mutually spaced in the direction of the axis of rotation 12 and are connected to one another in the manner of a cage via transposed bars 56. Each of the holding rings 54 is mounted freely pivotally on three bearing rollers 60 which are arranged on a frame 58. In each case the rollers 60 are mutually spaced approximately equidistant.

Figure 6:
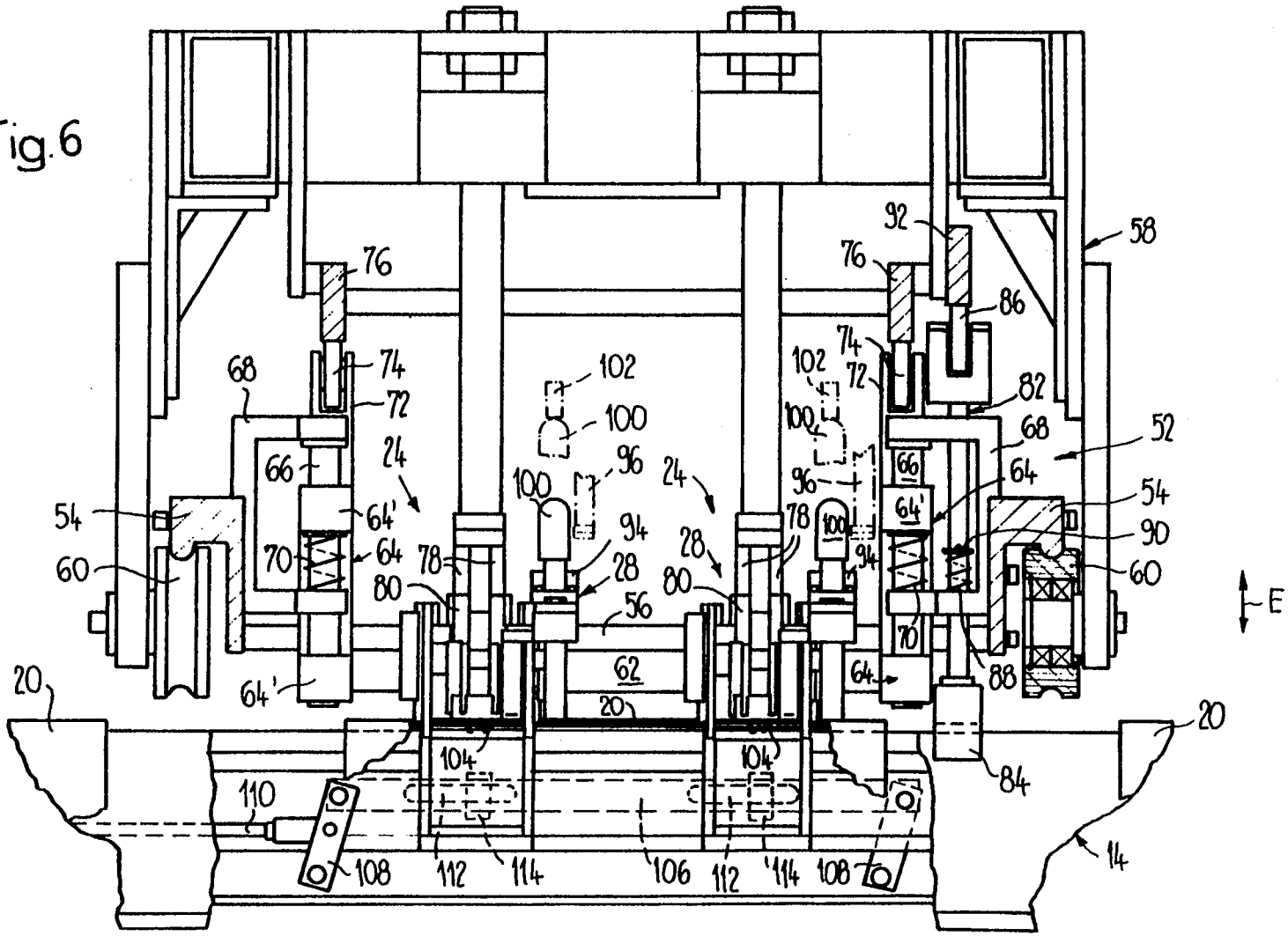
FIG. 6 shows an enlarged representation of a section along the line VI—VI of FIG. 5.

Each support 14 is assigned a stapling head 28 from each stapling head arrangement 24, which are fastened mutually spaced in the direction of the axis of rotation 12 to a common support section 62 (FIG. 6). A C-shaped bearing part 64 is fastened to the support section 62 at both ends. The C-shaped bearing part 64 is guided slidably in the radial direction E with its free end regions 64' on a bearing shaft 66 in each case. The bearing shaft 66 is arranged on a holding part 68, which is likewise C-shaped and fastened to the particular holding ring 54. The end region 64' of the bearing part 64 that is shown above in FIG. 6 is embraced by the holding part 68. A compression spring 70 is disposed around the bearing shaft 66, and is supported, seen in the direction E, inside on the holding part 68 and outside on the bearing part 64. Consequently, the compression springs 70 hold the stapling heads 28 in a rest position that is not shown in FIG. 6. In this rest position, the stapling heads 28 are raised from the supports 14 and the bearing parts 64 stand on the holding part 68.

The bearing parts 64 each have an arm 72, which projects outward in the radial direction over the relevant holding part 68 and on which a follower roller 74 is mounted freely pivotally in each case. A pair of lowering slotted links 76 acting upon these follower rollers 74 is fastened above the collector drum 10 by the frame 58.

Furthermore, in the region of the pair of lowering slotted links 76 a ram slotted link 78 assigned to each stapling head arrangement 24 is fastened to the frame 58. In each case, the ram slotted links 78 act on rams 80 of the stapling heads 28 in a region in which the stapling heads 28 are located in their contact position shown in FIG. 6.

A carrier 82 is slidably mounted in each case in the radial direction on the holding parts 68 which are fastened to a holding ring 54. At its end facing the support 14, the carrier 82 has an essentially V-shaped carrier section 84, and at its opposite end a follower roller 86 mounted freely pivotally. A further compression spring 88 embraces the carrier 82, and is supported, seen in the radial direction, at its inner end on the holding part 68, and at its outer end on a ring 90 which is fastened to the carrier 82. A carrier control slotted link 92 is arranged on the frame 58 and acts upon the follower rollers 86 approximately above the upper half of the track of travel 26 of the stapling heads 28. By means of this carrier control slotted link 92, the particular carrier section 84 can be lowered from a rest position (not represented in FIG. 6), in which the carrier section 84 stands on the holding part 68, against the force of the further compression spring 88 into a driving position represented in FIG. 6, in which the V-shaped carrier section 84 embraces the saddle-shaped support 14.

Following the end of the pair of lowering slotted links 76 seen in the direction of rotation U, a releasing slotted link 96 (indicated in FIG. 6 by dots and dashes), which acts upon the clamp lever 94 of the stapling heads 28, is arranged on the frame 58. Furthermore, following the wire section dispenser 30 indicated by an arrow, a matrix 98 shaped like a slotted link, which acts upon the wire section 38, and a swivel slotted link 102 acting upon an actuating shaft 100 of the stapling heads 28 are arranged on the frame 58 (see FIG. 5).

The support 14 is represented partially cut away in FIG. 6. Located mutually overlying on the support 14 are printed sheets 20. Represented in cut away is the case wherein the printed sheets 20 are located beneath the stapling heads 28 showing the staples 104 inserted in the sheets 20.

In the interior of the support 14, a coupler 106 is swivelably mounted on two pivoted levers 108 in the form of a parallel crank drive. The levers 108 extend parallel to one another and are swivelably mounted on the support 14. The pivoted lever 108, represented on the left in FIG. 6, is coupled to a control level 110, which can be moved to and from in the longitudinal direction of the support 14 by means of a control arrangement (not represented). This up and down movement of the control lever 110 leads to a to and from movement of the coupler 106 in the radial direction E. In the region of the stapling heads 28, slots 112 are provided in the coupler 106 which act in the direction of the arrow E upon a bend-over ram 114, indicated only diagrammatically.

Figure 7:
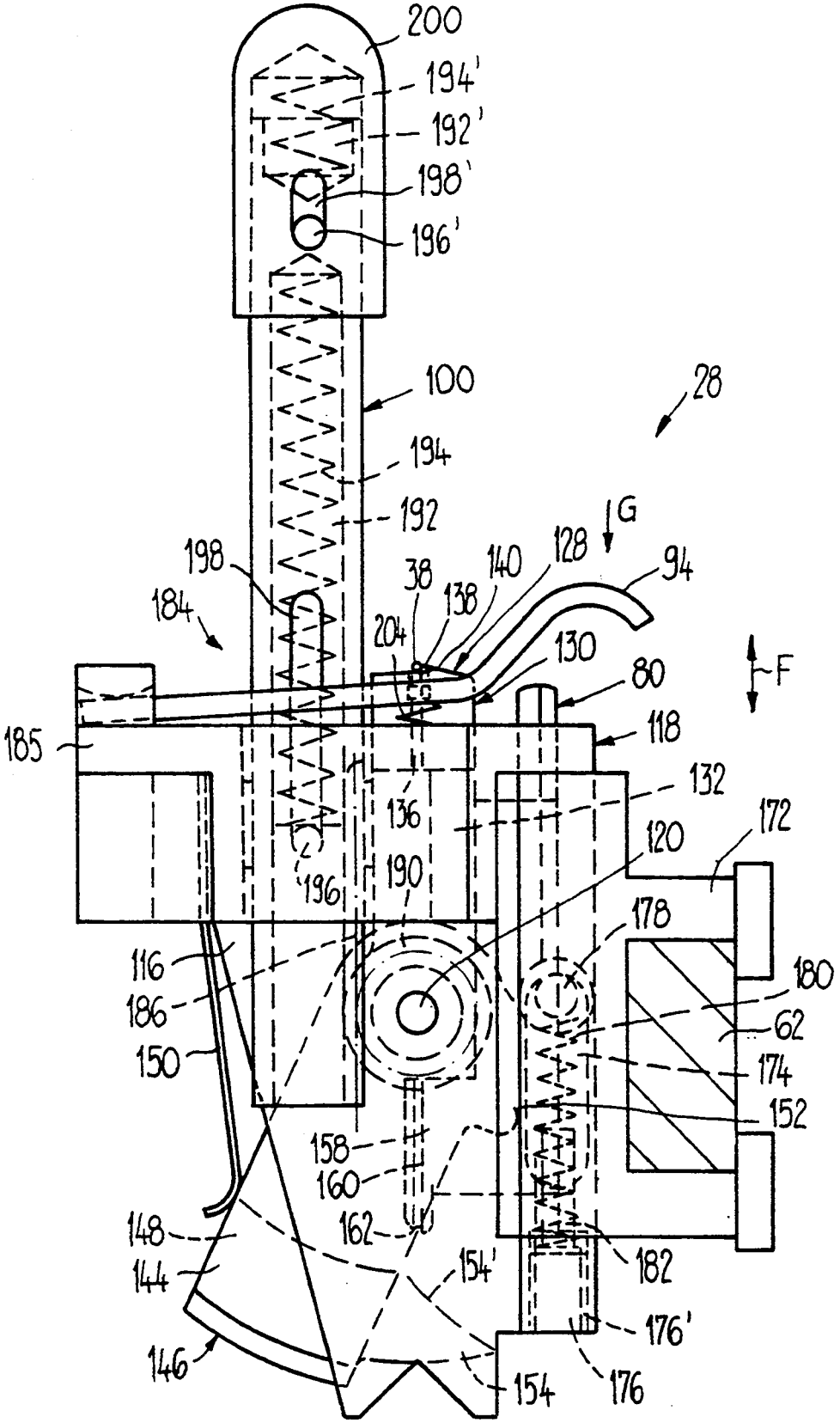
FIGS. 7 and 8 show a stapling head in elevation and top view, respectively.
Figure 8:
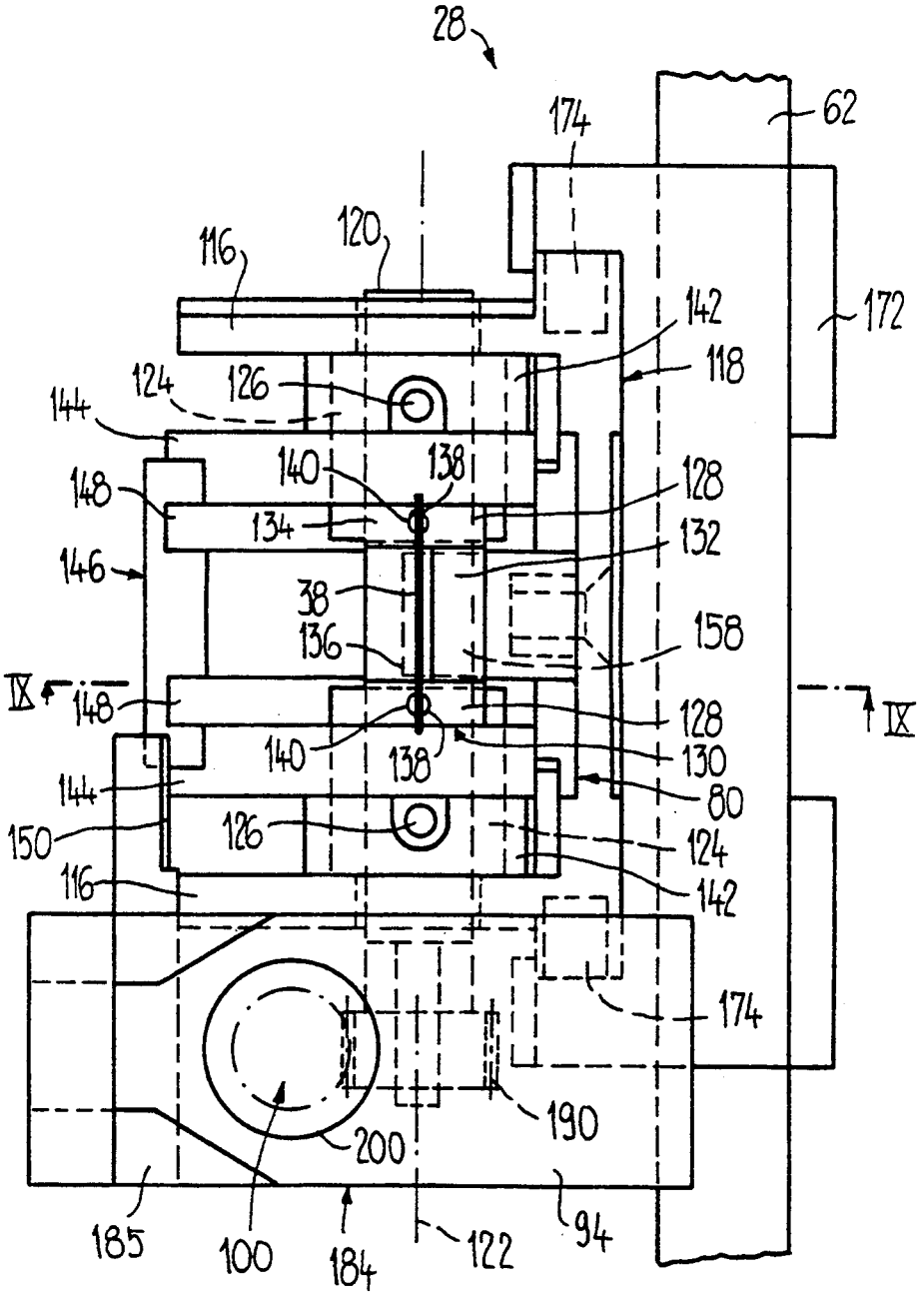
Figure 9:
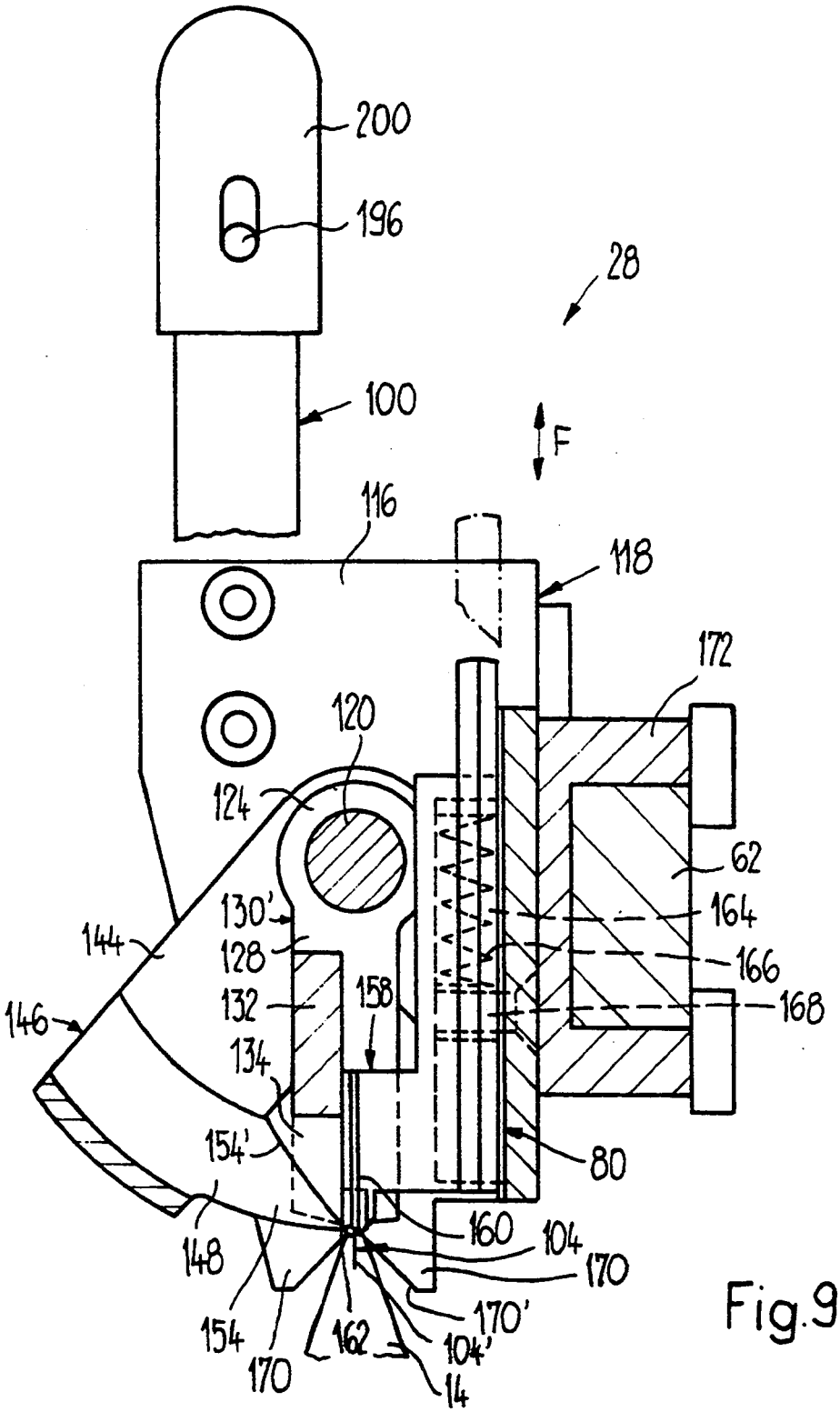
FIG. 9 shows a section along the line IX—IX of FIG. 8.

For the purpose of a better understanding of the mode of operation of the apparatus shown in FIGS. 5 and 6, the first step is now to describe the stapling heads 28 in more detail below with reference to FIGS. 7 to 9. Mounted freely pivotally on the lateral sides 116 of a supporting part 118, which is essentially U-shaped, is a shaft 120. The shaft 120 has a swivel axis 122, which is indicated by dots and dashes, extending parallel to the longitudinal direction of the support section 62 (cf. FIG. 6) and thus parallel to the axis of rotation 12 of the collector drum 10. Two mutually spaced bushes 124, are seated on the shaft 120 in the region between the two lateral sides 116 and are rotationally firmly connected to the shaft 120 by means of pins 126. Stamp arms 128 of a stamp 130, which extend parallel to one another, are fastened to the two mutually spaced bushes 124. The two stamp arms 128 are connected to one another by means of a lateral web 132. In the free end region, the two stamp arms 128 have a slight swelling 134 directed against one another, in which there are provided grooves 136 which are open with respect to one another and extend in the radial direction. These grooves 136 are also open in the radial direction at the free end of the stamp 130. At its free end, next to the groove 136, each stamp arm 128 has a drive nose 138, projecting in the radial direction, and a permanent magnet 140 arranged in the stamp arm 128. Shown in FIGS. 7 and 8 is a wire section 38 that is grasped by the drive noses 138 and held by the permanent magnets 140. The stamp 130 is shown in its rest position in FIGS. 7 and 8, and in the staple placing position 130′ in FIG. 9.

On each bush 124, a spacer bush 143 is seated in the region of the pin 126, and a pivoted lever 144 is mounted freely pivotally between the spacer bush 142 and the relevant stamp arm 128. A staple holding element 146, which is essentially constructed in the form of an annular segment and connects the two pivoted levers 144 to one another, is arranged at the free end regions of the pivoted levers 144. Formed into the staple holding element 146 are two mutually spaced grooves 148, in which the free end regions of the stamp arms 128 engage upon swiveling of the stamp 130. A leaf spring arrangement 150 is fastened to the supporting part 118. The leaf spring arrangement 150 acts with a force which is directed counterclockwise upon one pivoted lever 144 and presses the pivoted lever 144 together with the stops 152 integrally formed on them against the supporting part 118. The staple holding element 146 has a staple guide nose 154 projecting counterclockwise over the pivoted lever 144. This staple guide nose 154 is constructed in the form of a wedge, and has a wedge face denoted by 154′ which is directed inward when seen in the radial direction.

The ram 80 is slidably guided in the direction of the arrow F on the supporting part 118. This sliding direction F extends parallel to the grooves 136 in the stamp arms 128 when the stamp 130 is located in the staple placing position 130′. At its lower end region, the ram 80 has a ram head 158, which engages between the two stamp arms 128 when the stamp 130 is located in the staple placing position 130′. Integrally formed on the ram head 158 are laterally projecting guide wedges 160. When the ram 80 is slid in the direction F from its rest position shown in FIG. 7, the projecting guide wedges 160 run into the ejection position shown in FIG. 9, and when the stamp 130 is located in the staple placing position 130′, the projecting guide wedges 160 enter the grooves 136. At its lower end, the ram head 158 has a ram groove 162 for ejecting the staple 104, which is guided with its lateral arms 104′ in the grooves 136. Furthermore, the ram 80 has a groove-shaped cutout 164 open towards the supporting part 118, in which a compression spring 166 is arranged. The compression spring 166 is supported at its upper end on the ram 80 and at its lower end on a bolt 168, which is fastened to the supporting part 118 and reaches into the groove-shaped cutout 164 (FIG. 9). The compression spring 166 holds the ram 80 in the rest position indicated in FIG. 7 with unbroken lines and in FIG. 9 with dots and dashes.

At the lower end with respect to the stamp 130 located in the staple placing position 130', the lateral sides 116 have projecting holding noses 170. The projecting holding noses 170 are separated from one another by an essentially V-shaped cutout 170'. When the stapling head 28 is lowered, it comes to bear with the holding noses 170 against the support 14 or against the printed sheets 20 deposited thereupon.

The supporting part 118 is slidably mounted, likewise in the direction of the arrow F, in a bearing arrangement 172 fastened to the support section 62 (cf. also FIG. 6). At the lateral ends, the supporting part 118 likewise has groove-shaped cutouts 174 (FIGS. 7 and 8), into which a bore 176 with a thread 176' opens from below in each case. Further bolts 178, which engage in the groove-shaped cutouts 174 and on which one further compression spring 180 each is supported at the upper end, are arranged on the bearing arrangement 172. At its lower end, this compression spring 180 presses against a screw 182 inserted into the thread 176'. Consequently, in relation to the bearing arrangement 172, the compression spring 180 holds the supporting part 118 in the lower rest position shown in FIG. 7, on which the supporting part 118 is supported on the bolt 178. When the support section 162 is lowered (cf. FIG. 6) by the action of the pair of lowering slotted links 76 upon the follower rollers 74, the supporting part 118 comes to bear with the holding noses 170 against the support 14 or against the printed sheets 20 deposited thereupon. The differing position of the lowered stapling head 28, which is occasioned in relation to the support 14 by printed sheets 20 of varying thicknesses, is now accommodated by sliding the supporting part 118 in relation to the support section 62 (and bearing arrangement 172), which section is always lowered to the same extent.

A drive arrangement 184 for swiveling the shaft 120 is fastened to one lateral side 116 of the supporting part 118, which side is represented below in FIG. 8. The shaft 120 has a guide element 185, on which the actuating shaft 100 is slidably mounted, likewise in the direction of the arrow F. Integrally formed at the lower end region on the actuating shaft 100 is a toothed rack 186. The toothed rack meshes with a pinion 190, which is seated rotationally firmly on the shaft 120. A further compression spring 194, is arranged in a bore 192, which is open downwards in the actuating shaft 100. The compression spring 194 is supported at its upper end on the actuating shaft 100 and at its lower end on a pin 196 fastened to the guide element 185. The pin 196 penetrates an elongated passage 198 in the actuating shaft 100. The upper end region of the actuating shaft 100 is covered by a cap-shaped sliding shoe 200, which is slidable in the longitudinal direction in relation to the actuating shaft 100 and is held by means of a further pin 196'. The further pin 196' is attached to the actuating shaft 100 and penetrates the sliding shoe 200 in a passage 198' that is likewise elongated. A further compression spring 194', which is supported on the sliding shoe 200 and on the actuating shaft 100, is inserted into a bore 192', open upwards, in the actuating shaft 100. If the actuating shaft 100 is located in its lower end position shown in FIG. 9, and the swivel slotted link 102 approaches the supporting part 118 even more closely, the compression spring 194' accommodates this approach.

The clamp lever 94, which is penetrated by the actuating shaft 100, is swivelably mounted on the guide element 185. The corresponding hole in the clamp lever 94 has a diameter that is only slightly larger than the thickness of the actuating shaft 100. The clamp lever 94 is held pretensioned counterclockwise by means of a compression spring 204. In the position of the clamp lever 94 shown in FIG. 7, the lever 94 holds the actuating shaft 100 in place by tilting. By applying a force in the direction of the arrow G by means of the releasing slotted link 96 (cf. FIG. 6) this tilting is undone by swiveling the clamp lever 94 clockwise, and the actuating shaft 100 is released, the latter being slid upwards by the compression spring 194.

The mode of operation of the stapling head 28 will now be described in conjunction with FIGS. 10 to 15. These figures show part of the stapling head 28 during various phases of an operational cycle. The corresponding parts of the stapling head 28 are numbered in these figures in the same way as in FIGS. 7 and 9, and will therefore not be explained in more detail. The bend-over ram 114 is guided to slide up and down in the support 14 (FIGS. 12 to 15) in the direction of the arrow E. Supported on it are two benders 206 that are swivelably mounted on the support 14 (cf. also FIG. 6 in this connection).

Figure 10:
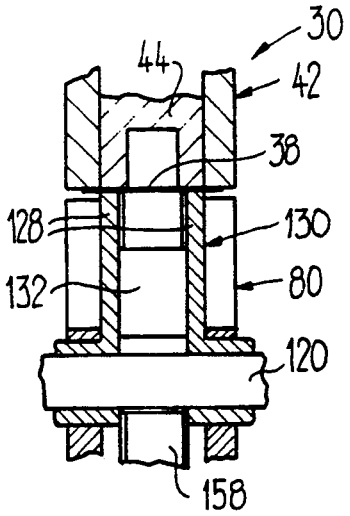
FIGS. 10 and 15 show a simplified representation of the stapling head at different phases of an operational cycle.

In FIG. 10, the stamp 130 is located in its rest position, also shown in FIGS. 7 and 8. The ram 80 with its ram head 158 is likewise located in the rest position. The stapling head 28 moves past the conveyor wheel 42 of the wire section dispenser 30 (cf. FIG. 1), and in so doing accepts a wire section 38 from the holding element 44 of the conveyor wheel 42 drive by means of the drive noses 138. The wire section 38 is held on the stamp arms 128 by means of the permanent magnets 140 (not shown in this Figure). The web connecting the two stamp arms 128 to one another is illustrated by 132.

Figure 11:
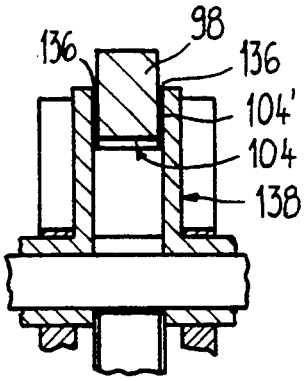
Figure 12:
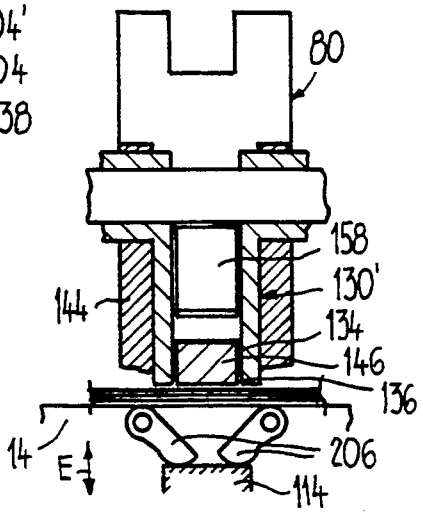
Figure 13:
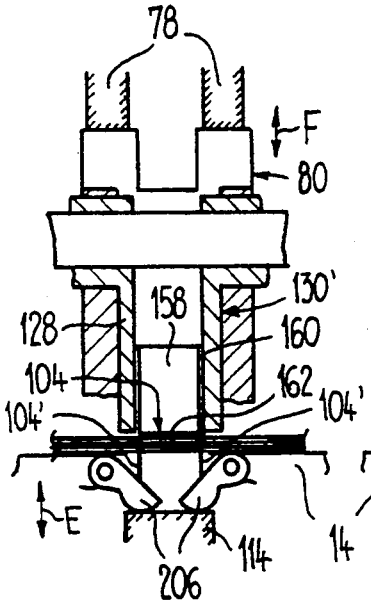
Figure 14:
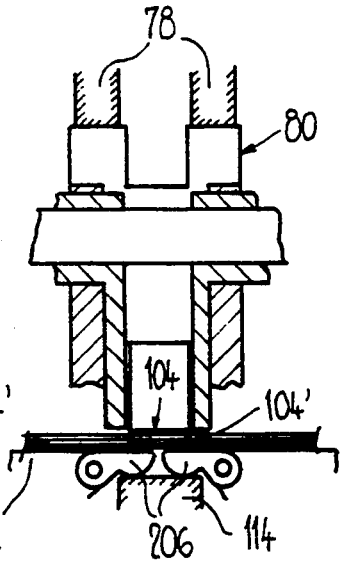
Figure 15:
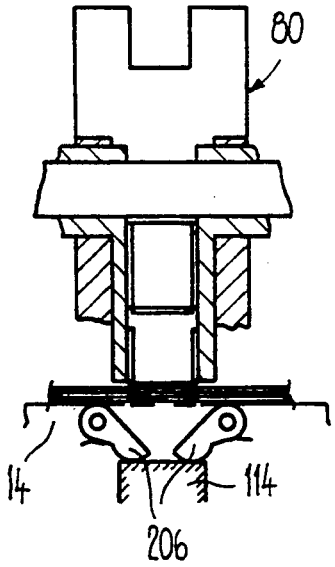

In FIG. 11, the stapling head 28 is located in the region of the matrix 98 (see FIG. 5), the stamp 130 still being located in its rest position. As the stapling head 28 slides along the matrix 98, the wire section 38 is bent in the shape of a U to form a staple 104, the lateral arms 104' sliding into the grooves 136 of the stamp arms 128. Due to the effect of the swivel slotted link 102 on the sliding shoe 200, the actuating shaft 100 is brought into its lower end position shown in FIG. 9, with the result that the stamp 130 is swiveled into the staple placing position 130' shown in FIGS. 9 and 12. In the course of this swiveling movement, the stamp arms 128 engage in the region of their swelling 134 in the grooves 148 of the staple holding element 146, so that the lateral arms 104' are held in the grooves 136. The pivoted lever, designated by 144, is fastened to the staple guide element 146. In the staple placing position 130' of the stamp 130 the ram head 158 of the ram 80 is likewise located between the two stamp arms 128, but in the region between the shaft 120 and the swellings 134. When the ram slotted link 78 acts upon the ram 80, the latter is pushed in the direction of the arrow F against the support 14, as is shown in FIG. 13. In this process, the guide wedges 160, which are integrally formed laterally on the ram 158, slide into the grooves 136 of the stamp arms 128 located in the staple placing position 130'. The staple 104 is ejected from the stamp 130 by the ram groove 162, the lateral arms 104' simultaneously being pushed through the printed sheets 20 which are deposited on the support 14. As the ram 80 is lowered, it slides on the wedge face 154' of the staple guide nose 154, so that the staple holding element 146 which is fastened to the pivoted levers 144 is swiveled clockwise (cf. FIG. 9). In this process, the staple guide nose 154 holds the lateral arms 104' of the staple 104 in the grooves 136 until the staple 104 is inserted into the printed sheets 120 and the staple guide nose 154 is swiveled out of the region of the grooves 136. The subsequent raising of the bend-over ram 114 in the direction of the arrow E swivels the benders 206 in the upwards direction. As a consequence, the sections of the lateral arms 104' that project in the region of the benders 206 are bent over with respect to one another (FIG. 14). In this process, the ram 80 is still held in the lower end position by the ram slotted link 78. After the ram 80 has returned from the ram slotted link 78, it once again moves back under the force of the compression spring 166 into the upper rest position, as is shown in FIG. 15. The lowering of the bend-over ram 114 in the direction of the arrow E also swivels the benders 206 back into their original position. As the stapling head 28 runs past the releasing slotted link 96, the actuating shaft 100 is released from the clamp lever 94, and this causes the stamp 130 to swivel back into the rest position.

Figure 5:
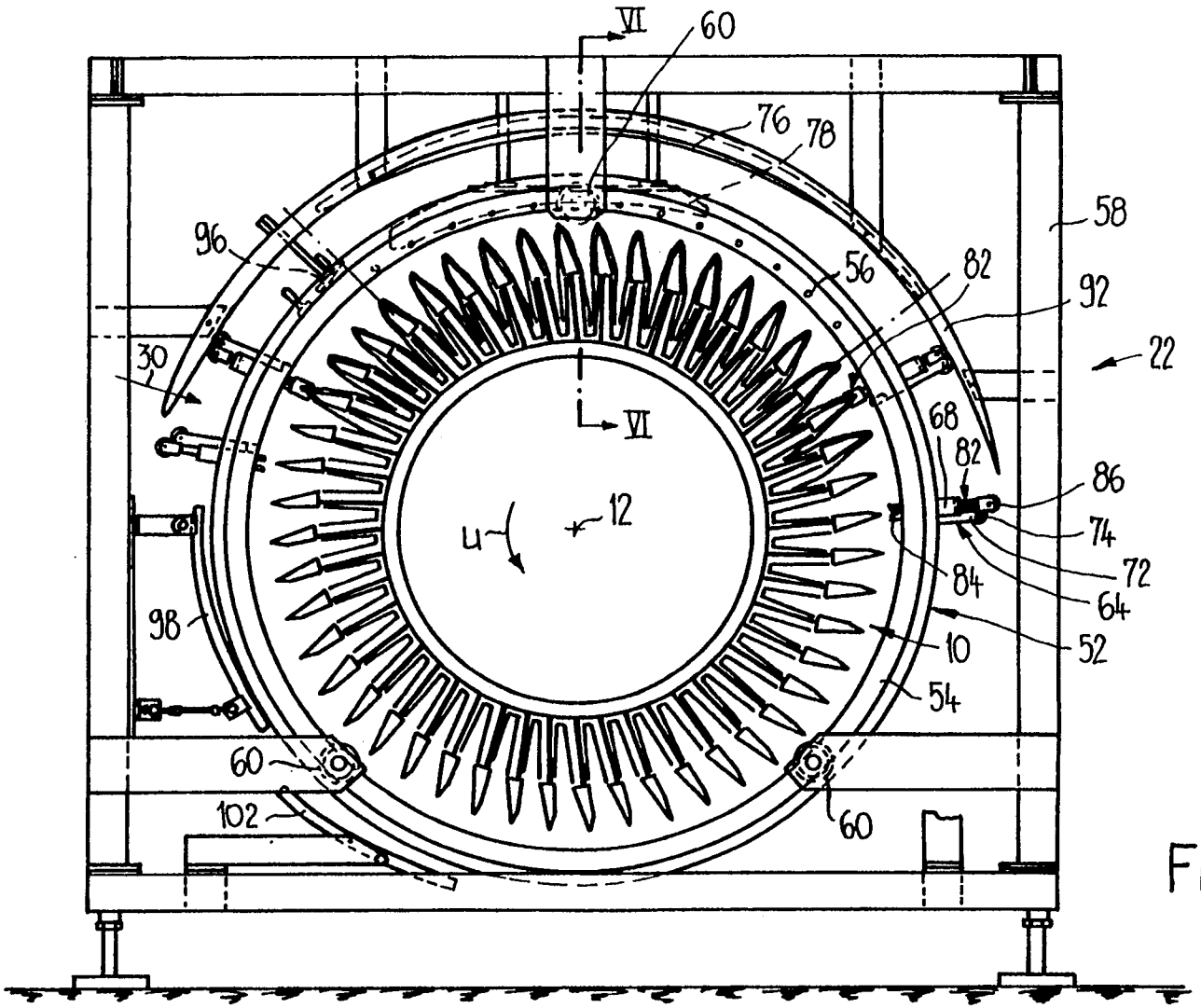
FIG. 5 shows a further embodiment of the invention according to FIG. 1.
Figure 16:
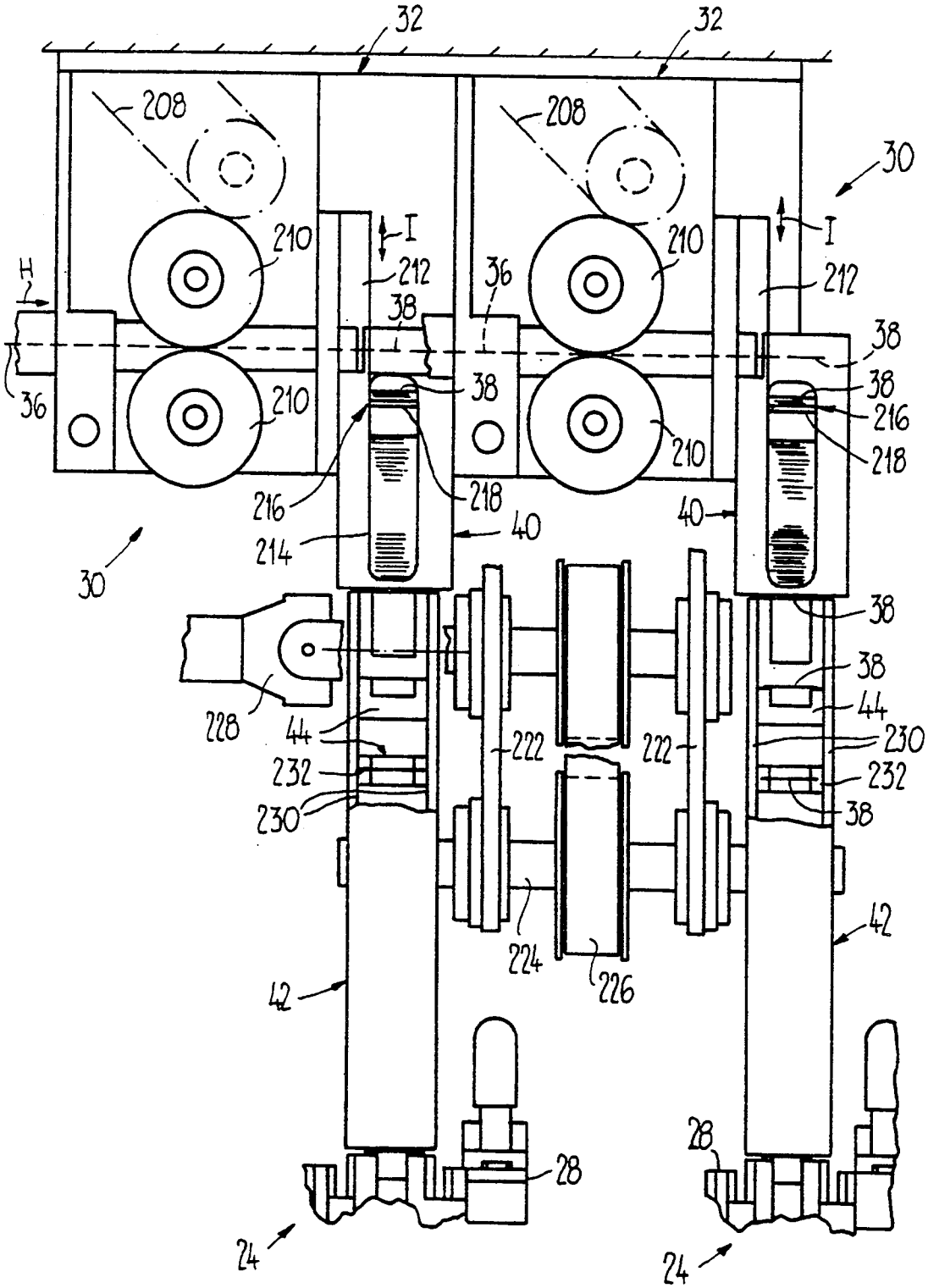
FIGS. 16 and 17 show a wire section dispenser in elevation and end views respectively.
Figure 17:
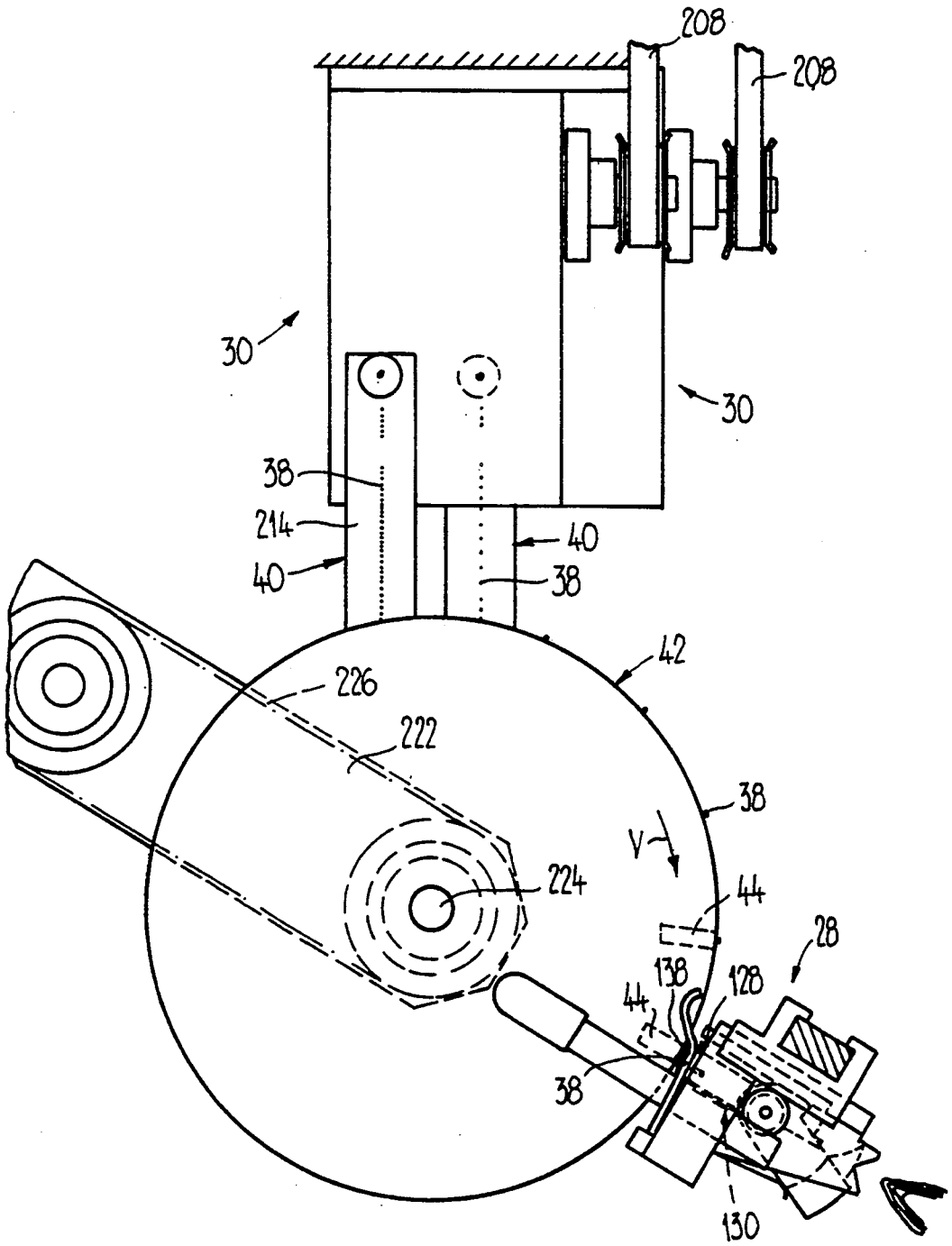

The wire section dispensers 30, which are indicated in FIG. 5 by the arrow 30 and assigned to the two tapering head arrangements 24, are shown enlarged in FIGS. 16 and 17. Each of these wire section dispensers 30 is constructed in the same way as the wire section dispenser 30 shown in FIG. 1. The cutting device 32 is driven via a rotating toothed belt 208. A pair of conveyor rollers 210 conveys the wire 36, which is clamped therebetween, in steps in the direction of the arrow H. A cutting blade 212, can be moved up and down in the direction of the arrow I. The cutting blade 212 severs a wire section 38 from the wire 36 by being lowered after each conveying movement of the wire 36. A magazine 40 is arranged below the cutting device 32, downstream of the cutting blade 212. The magazine 40 has an essentially slit-shaped stacking shaft 214 extending approximately in the vertical direction. The wire sections 38 fall in the stacking shelf 214 so that they extend longitudinally in an essentially horizontal direction and are stacked above one another.

Provided at the upper end of the stacking shaft 214 is a prestacking device 216. The prestacking device includes a tongue 218 which can be moved into the region of the stacking shaft 214 and once again withdrawn therefrom. When the tongue 218 is moved into the region of the stacking shaft 214, a number of wire sections 38 severed from the wire 36 by means of the cutting device 32 are stacked. A brief withdrawal of the tongue 218 causes these stacked wire sections 38 to then fall together into the stacking shaft 214. This prevents erection and tilting of the wire sections 38 during free fall, and guarantees neat stacking of the wire sections 38 in the stacking shaft 214.

The two conveyor wheels 42 arranged below the magazine 40 are firmly seated rotationally on a common bearing shaft 224, which is pivotally mounted on a pair of support levers 222. The two conveyor wheels 42 are driven to rotate in the direction of the arrow V by a drive device 228 acting upon the bearing shaft 224 via a drive belt 226.

Each conveyor wheel 43 has two mutually spaced parallel disks 230, between which the holding elements 44 are arranged at specific spacings along the circumference. The holding elements are preferably constructed in the form of a U, and have at their free ends, which are directed outward in the radial direction, carrier sides 232 projecting slightly above the periphery of the disks 230. In a manner similar to that described above in connection with the stapling head 28, a permanent magnet arrangement is provided on the holding elements 44, in order to hold in place the wire sections 38 which are released from the stacking shaft 214 by means of the carrier sides 232 while running past the magazine 40.

The stapling heads 28 are more widely mutually spaced than the holding elements 44. Consequently, the circumferential speed of the conveyor wheels 42 is lower than the rotational speed of the stapling heads 28, such that in each case the next stapling head 28 coincides with the next holding element 44. Thus, the stapling head 28 runs past the holding element 44, and draws the relevant wire section 38 from the holding element 44 with the drive noses 138 arranged on the stamp arms 138, and holds the wire section in place by means of the permanent magnets 140 on the stamp 130. The holding elements 44 are arranged slidably and resiliently in the radial direction in a generally known fashion, in order to be able to accommodate tolerances, and to guarantee a reliable acceptance of the wire sections 38 from the stacking shaft 214 and transfer to the stapling heads 28.

The mode of operation of the stapling stations 22 represented in FIGS. 5 and 6 will now be explained with the aid of FIGS. 18 to 24.

Figure 18:
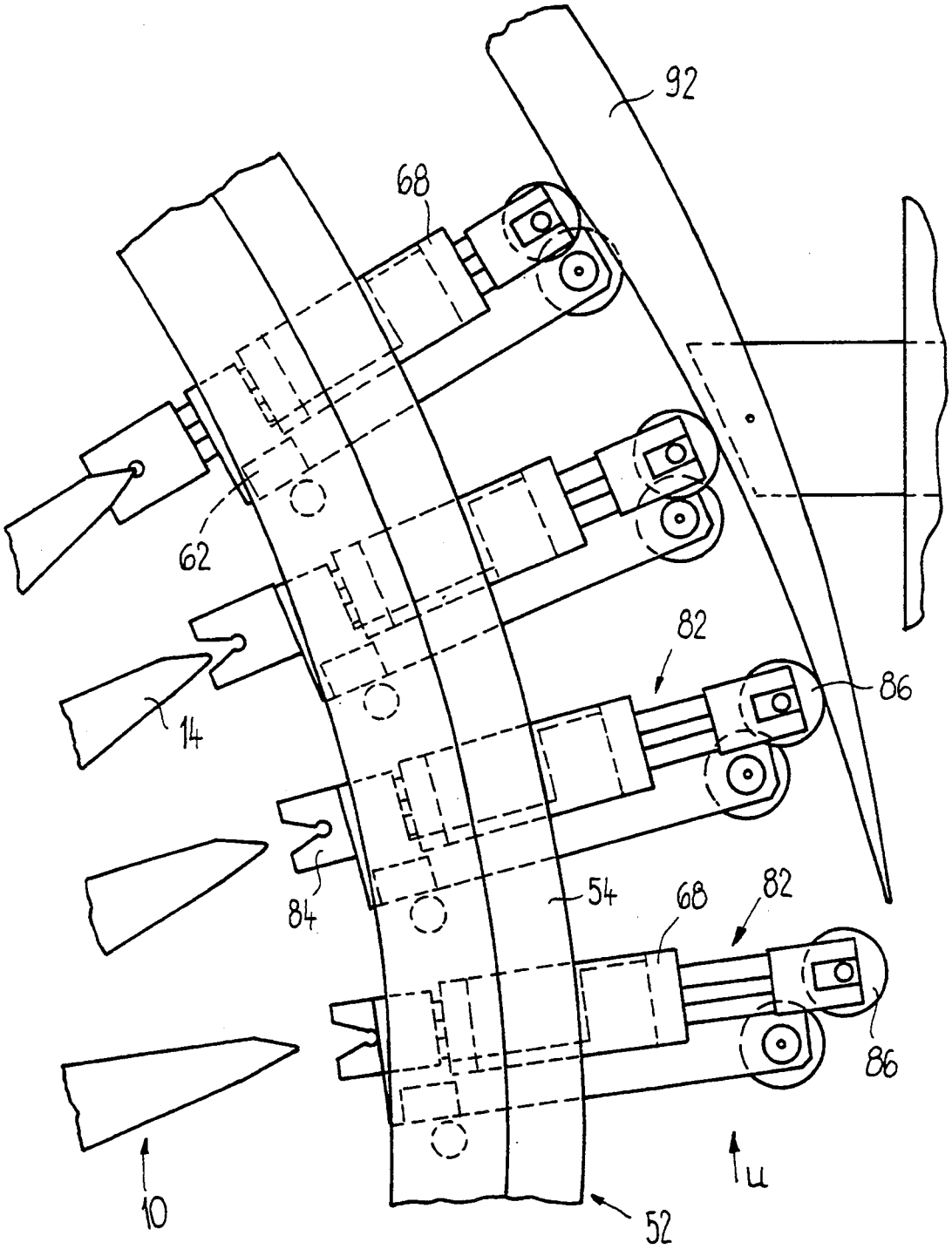
FIGS. 18 to 24 show an enlarged representation of parts of the apparatus according to FIG. 5 at various phases of a rotation.

The initial region of the carrier slotted link 92 is represented in the direction of rotation U in FIG. 18. As the follower rollers 86 of the carriers 82 rotate in the direction of the arrow U, they run up onto the carrier slotted link 92. As a consequence, the carriers 82, which are slidably guided in the radial direction on the holding part 68, are lowered onto the relevant supports 14 of the collector drum 10. In this process, the V-shaped carrier sections 84 embrace the supports 14. Consequently, the stapling heads 28 (not shown in FIG. 18) which are arranged on the support section 62 are accurately aligned relative to the assigned support 14 or to the printed sheets 20 deposited thereupon. Furthermore, the holding arrangement 52 is driven exclusively by driving effected by the carriers 82 engaged with the supports 14. The carriers 82 are lowered only in the upper region of the rotation track of the collector drum 10 onto the supports 14. In this manner, in the lower region of the rotation track, the printed sheets 20 which have been stapled by means of the stapling station 22 can be conveyed away in the direction of the axis of rotation 12 through the now mutually spaced supports 14 and carrier sections 84, or the printed sheets 20 which are to be stapled can be brought into the region of the stapling station 22.

Figure 19:
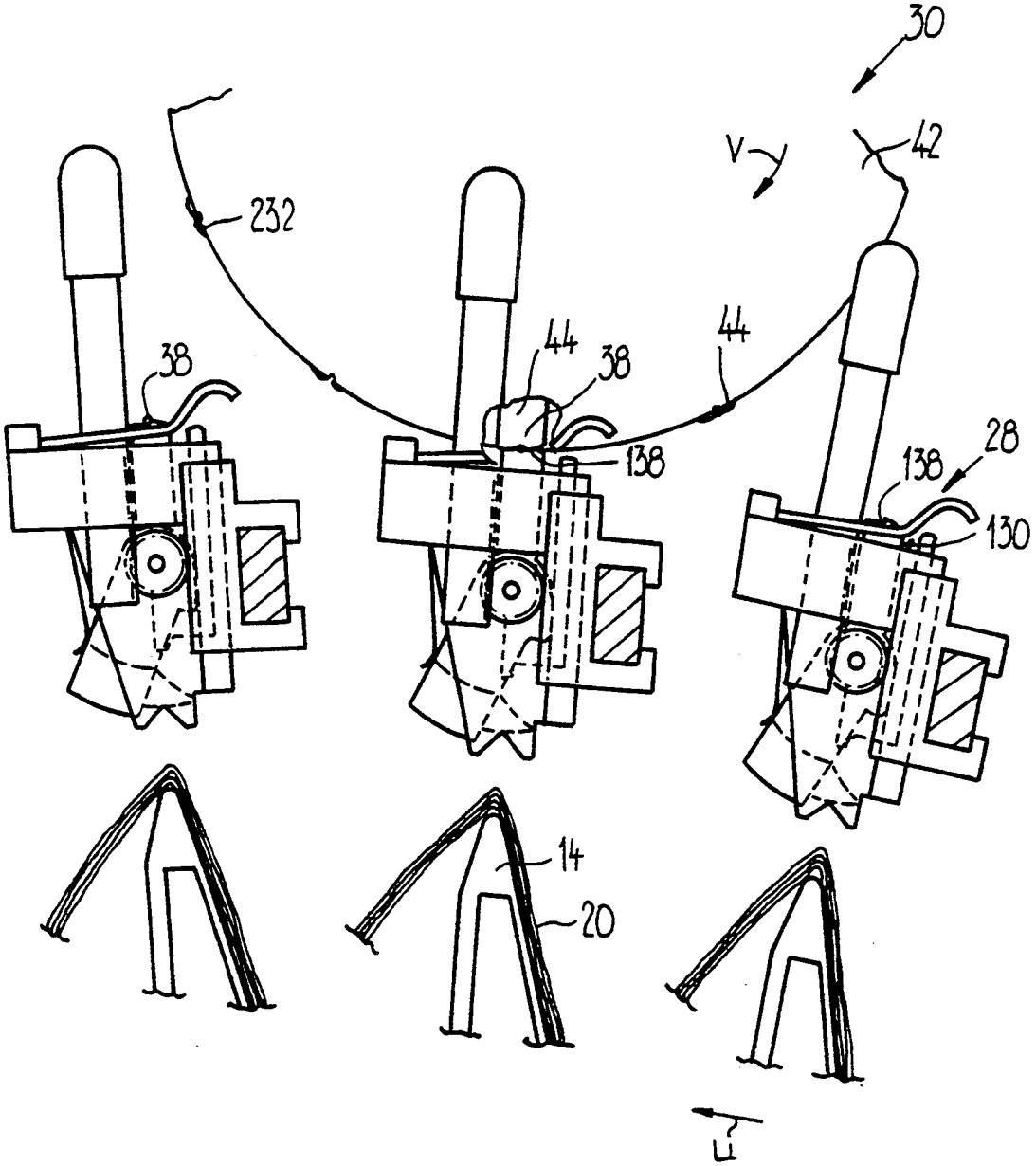

A stapling head 28 will now be followed in the course of a rotation of the holding arrangement 52, starting at the wire section dispenser 30. As the stapling heads 28 run past the wire section dispenser, the heads 28 are located, seen in the radial direction, in their outer rest position, in which they are spaced from the supports 14. Moreover, the staples 130 are swiveled back into the rest position, so that the free ends of the stamp arms 128 are directed outward, seen in the radial direction. As the stapling head 28 runs past the relevant holding element 44 of the conveyor wheel 42, the wire section 38 which is fed from the holding element 44 is detached by the drive noses 138 from the holding said element 44, and carried along (FIG. 19).

Figure 20:
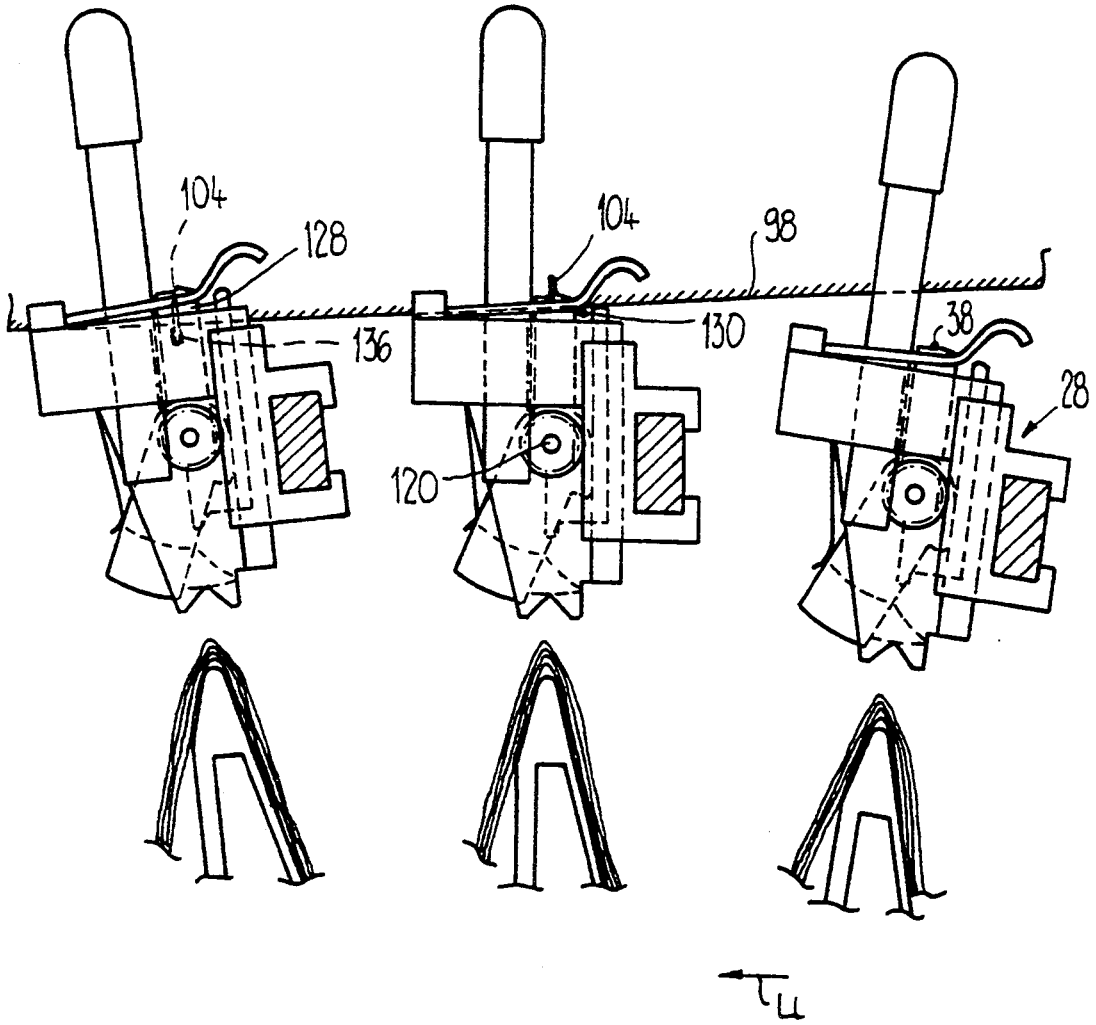
Figure 21:
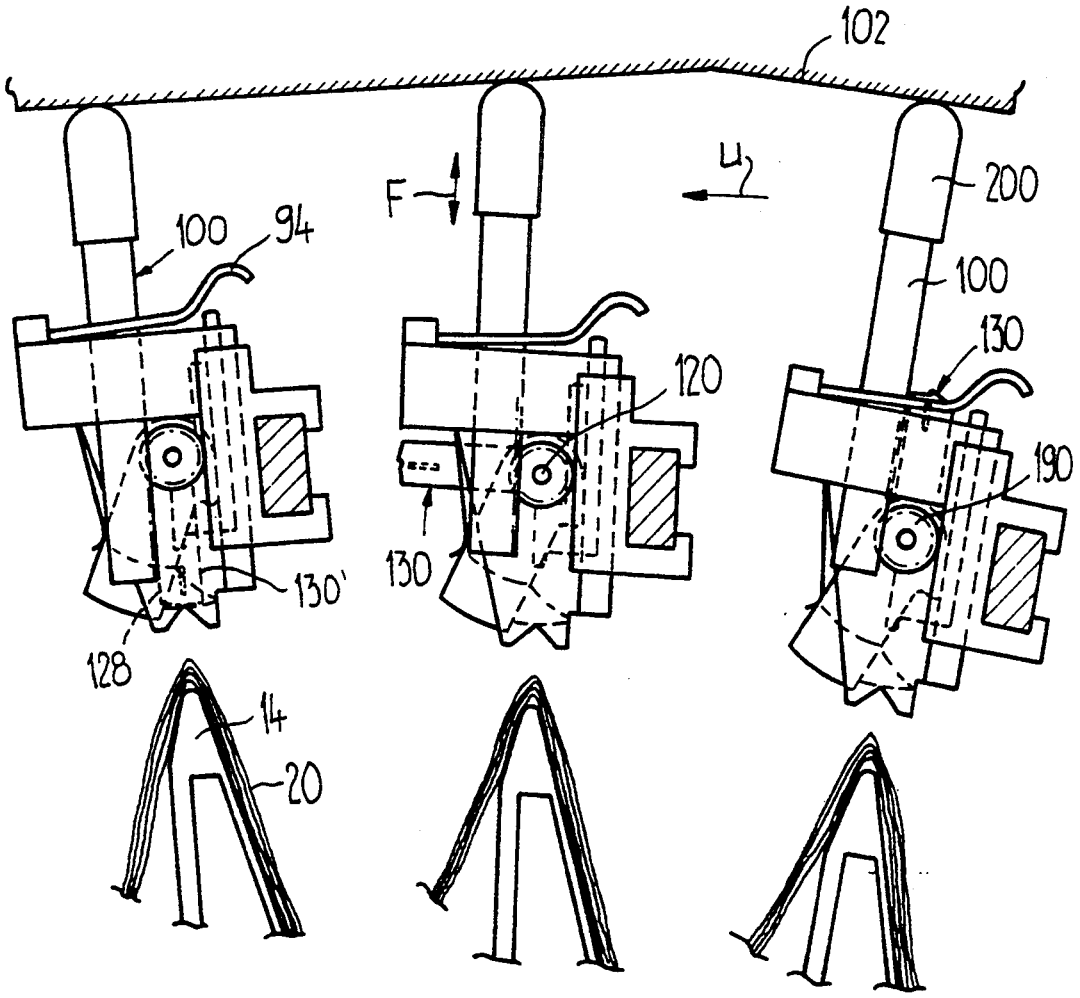
Figure 22:
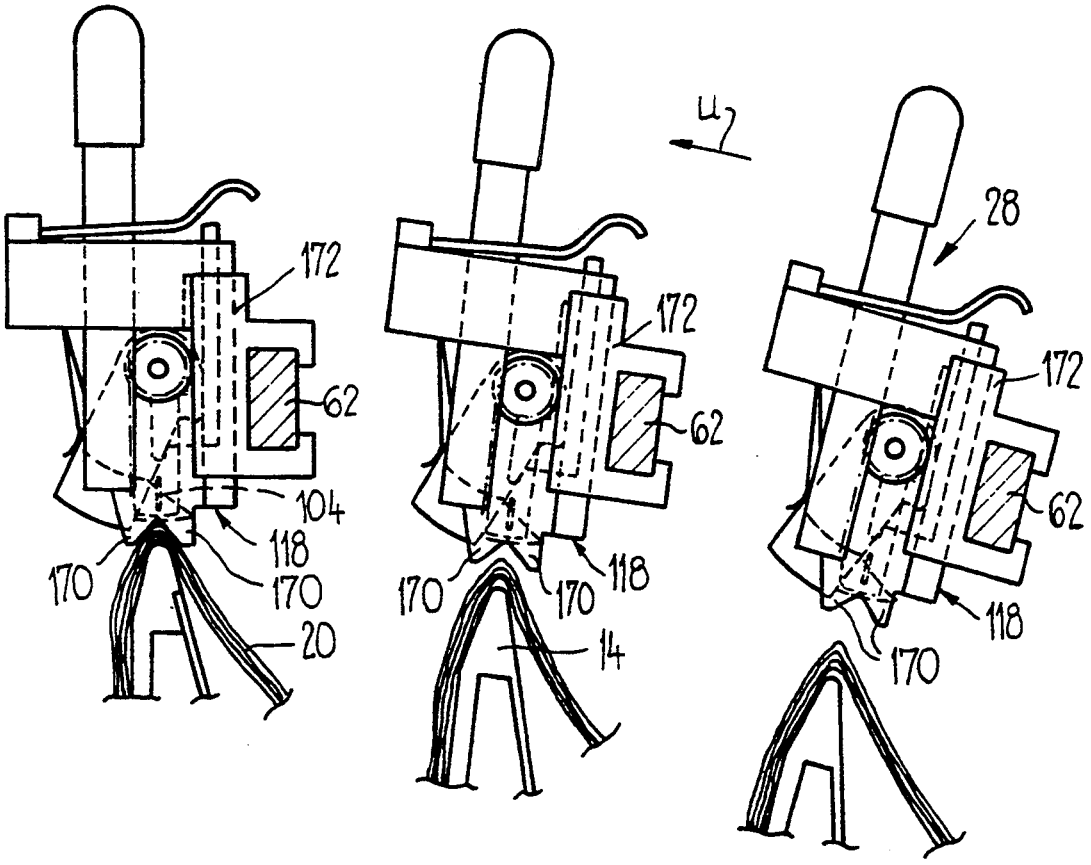

In the course of the further rotation in the direction of the arrow U, the stapling heads 28 pass into the region of the matrix 98, as is shown in FIG. 20. The matrix 98 is formed in the shape of a slotted link. Seen in the direction of the arrow U, the spacing between the matrix 98 and the shaft 120 decreases, so that when the stamp 130 is located in the rest position the relevant wire section 38 is bent to form a staple 104, and pushed into the grooves 136 of the stamp arms 128 (FIG. 20). Upon reaching the swivel slotted link 102, the sliding shoe 200 runs up onto the latter, and as a result the actuating shaft 100 is forced inward in the radial direction in the direction of the arrow F. This translational movement of the actuating shaft 100 is converted via the pinion 190 into a swiveling movement of the shaft 120. As a result, the stamp 130 is swiveled counterclockwise 180° from its rest position into the staple placing position 130', whereupon the free ends of the stamp arms 138 now face the supports 14 inward in the radial direction. The clamp lever 202 holds the actuating shaft 100 in its lower end position against the force of the compression spring 194 (cf. FIG. 7) (FIG. 21).

In the course of the further rotation in the direction of the arrow U, upon reaching the carrier slotted link 92 the carriers 82 are lowered onto the supports 14, as is described above. The follower rollers 74 subsequently pass into the region of the pair of lowering slotted links 76 (see FIGS. 5 and 6), so that the support section 62 with the stapling heads 28 which is arranged thereupon is lowered to a specific extent in the direction against the supports 14. In this process, the supporting part 118 with its holding noses 170 comes to bear against the printed sheets 20, which rest astride the supports 14.

It should be noted that the holding noses 170 hold the printed sheets 20, seen in the direction of the support 14, in place in front of and behind the staple 104, and on both sides of the latter. This arrangement leads to especially neat stapling. It should also be noted that the supporting part 118 is displaced in relation to the bearing arrangement 172, which is fixed on the support section 62, as a function of the thickness of the printed sheets 20. Consequently, neat stapling of printed sheets 20 of different thicknesses is guaranteed without it being necessary to reset the apparatus (cf. FIG. 22).

Figure 23:
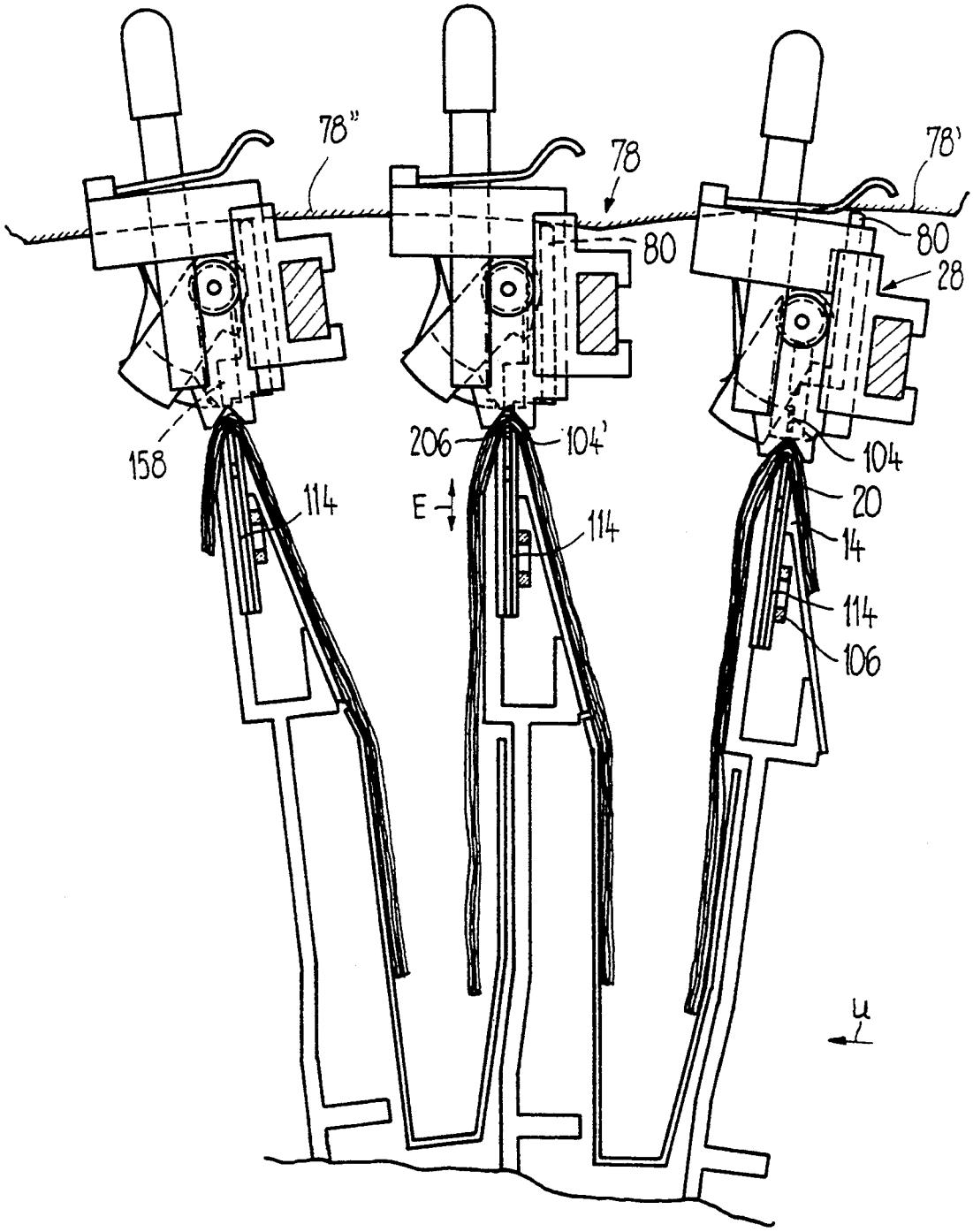

When the stapling heads 28 bear against the printed sheets 20, the heads 28 are conveyed against the ram slotted link 78. In a first section 78' seen in the direction of the arrow U, the ram slotted link 78 extends at a spacing that decreases towards the rotation track of the supports 14 (FIG. 23). In this region, the ram 80 is lowered in the direction against the printed sheets 20, so that the staple 104 is ejected from the stamp 130, and placed into the printed sheets 20. In a section 78'' which adjoins the section 78', the ram slotted link 78 extends at a constant spacing in relation to the supports 14. In this section, the ram head 158 forces the staple 104 tightly against the printed sheets 20. This prevents the staple 104 from falling back when the lateral arms 104' are being bent over as a consequence of raising of the bend-over ram 114 in the direction of the arrow E, and of the swiveling of the benders 206 connected thereto (cf. also FIGS. 12 to 15).

After the staple 104 is placed and the lateral arms 104' are bent over, the ram 80 slides back into its outer rest position, seen in the radial direction, under the action of the compression spring 166 and of the spacing from the supporting part 118, which increases in the end region of the ram slotted link 78.

Figure 24:
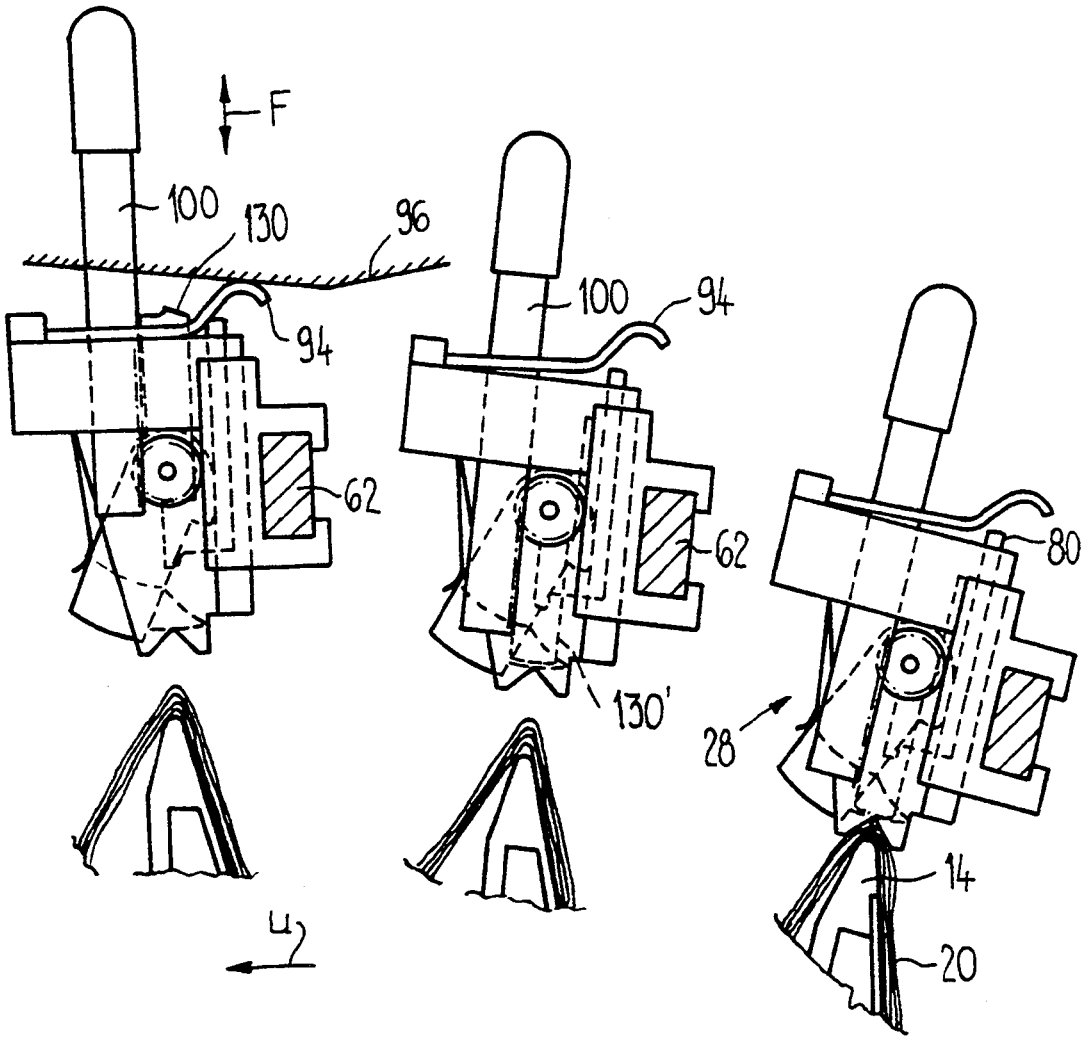

Following the ram slotted link 78, the spacing of the pair of lowering slotted links 76 increases in relation to the holding arrangement 52. As a result the stapling heads 28 are raised from the supports 14 or from the stapled printed sheets 20 deposited thereupon. This is illustrated in FIG. 24.

In the course of the further rotation, the stapling heads come into the region of the releasing slotted link 96, which swivels the clamp lever 94 clockwise. Consequently, the actuating shaft 100 is released, so that said shaft is pushed outward under the force of the compression spring 194 (cf. FIG. 7) in the radial direction in the direction of the arrow F. This leads, in turn, to the stamp 130 swiveling back clockwise from its staple placing position 130' into the rest position. The stapling heads 28 are now ready once again to accept a new wire from the wire section dispenser 30.

Upon further rotation of the collector drum 10, the stapled printed sheets 20 are now conveyed in the direction of the axis of rotation 12 away from the region of the stapling station 22 to a lead-away station (not shown).

The stapling heads 28 can be constructed very simply due to the separation of the wire section preparation and the wire stapling heads 28. Moreover, only a single wire section dispenser 30 is required per stapling head arrangement 24 thus reducing the expenditure to a minimum. Moreover, the wire section dispenser 30 can be removed from the region in which the staples 104 are placed into the printed sheets 20. As a result, enough time is available for preparing the staples 104 in the region between the wire section dispenser 30 and the staple placing region. In the case of stapling heads with swivable stamps 130, the preparation of the staples 104 can be performed in a position different from the staple placing position 130'. This means that the different functions of the stapling heads 18 are spatially separated from one another; the result of this is, in turn, that the stapling heads 28 are constructed simply as well as with small dimensions.

Of course, the matrix for bending the wire section 38 to form a staple 104 can be provided on each stapling head 28 itself. This matrix has a profile that is eccentric with respect to the shaft, so that the staple 104 is formed during the course of the swiveling movement of the stamp 130 from its rest position into the staple placing position 130'. Such a matrix could especially be integrally formed clockwise on the staple holding element 146 as an extension thereof.

It is, of course, also possible for the carriers to be arranged on the stapling heads. Therefore, it is entirely conceivable that the holding noses 170 could serve as carriers. In this arrangement, a separate drive for the stapling station 22 is no longer necessary, and synchronization problems between the rotation of the collector drum 10 and the stapling head arrangements 24 are eliminated.

Of course, the tension member or the holding arrangement 52 can be driven to rotate by means of its own drive motor. Furthermore, it is conceivable that the wire section dispenser could have a replaceable magazine, or that the wire sections could be fed directly to the stapling heads from the cutting device.

It remains to be mentioned in conclusion that, for the purpose of accepting the wire, the stamps 130 can be located in a wire acceptance position different from the rest position. However, the wire acceptance position does not correspond to the staple placing position 130'. The wire sections 38 extend essentially parallel to the swivel axis 122.

Stapling heads that are especially suitable for apparatuses according to the invention for collecting printed sheets are described in the contemporaneous Swiss Patent Application No. 01 963/89-1 "Stapling Apparatus" corresponding to contemporaneously filed U.S. patent application Ser. No. 07/528,735 (Attorney docket No. 3092/26).

An apparatus according to the invention with which a stapling head is permanently assigned to each support also allows the stapling heads of a stapling head arrangement to be mutually offset in the longitudinal direction of the supports. It is thus possible, for example, for each second stapling head to be slightly offset in relation to the other stapling heads arranged in a plane; the two groups of stapling heads then advantageously run past their own wire section dispenser in each case. All the staples do not then come to be located above one another during stacking of the stapled sheets.

I claim:

1. An apparatus for wire stapling multipart printed products along the line of a fold of the multipart printed products, comprising:

a conveyor arrangement for conveying the printed products to be stapled in a conveying direction along a track of travel through a stapling region , the line of the fold extending essentially perpendicular to the conveying direction;

at least one stapling head arrangement including a plurality of stapling heads for placing wire staples having lateral arms, the stapling heads rotating essentially at the rate of travel of the printed products along a closed track of travel and being arranged one behind another at spaced intervals in the direction of rotation, the rotation track extending in the stapling region along a section essentially parallel to the track of travel of the printed products;

at least one staple closing arrangement including a plurality of specific mating elements for closing the placed wire staples, the mating element cooperating in the stapling region with the stapling head and rotating synchronously with the stapling heads along a closed rotation track which extends essentially parallel to the track of travel of the products in the stapling region along a section which, with reference to the track of travel of the products, is disposed opposite the rotation track of the stapling heads; and a wire section dispenser unit, the wire section dispenser unit being arranged in a stationary fashion on the rotation track of the stapling heads and dispensing, in each case to the passing stapling heads, a wire section extending essentially perpendicular to the direction of the rotation of the stapling heads.

2. The apparatus as claimed in claim 1 wherein the wire section dispenser unit is disposed outside the stapling region.

3. The apparatus as claimed in claim 1 wherein the stapling head arrangement is separate from the conveyor arrangement.

4. The apparatus as claimed in claim 1 wherein the conveyor arrangement comprises saddle-shaped supports for the printed products, the supports rotating along a closed rotation track, extending mutually parallel, and extending essentially perpendicular to their direction of rotation.

5. The apparatus as claimed in claim 1 wherein the mating elements are provided in the supports for bending over the lateral arms of the wire staples, the arms being pushed through the printed products.

6. The apparatus as claimed in claim 4 wherein the supports rotate about a common axis of rotation extending essentially in the horizontal direction.

7. The apparatus as claimed in claim 6 wherein the track of travel of the stapling heads extends around the rotational track of the supports.

8. The apparatus as claimed in claim 4 wherein in the stapling regions the track of travel of the stapling heads and the track of travel of the supports extend essentially in a straight line.

9. The apparatus as claimed in claim 8 wherein the wire section dispenser unit is arranged on the inside of the closed track of travel of the stapling heads.

10. The apparatus as claimed in claim 1 comprising a second stapling head arrangement having an assigned second staple closing arrangement, the stapling heads of the two stapling head arrangements traveling along tracks of travel extending mutually parallel.

11. The apparatus as claimed in claim 10 wherein each stapling head arrangement is assigned its own wire section dispenser unit.

12. The apparatus as claimed in claim 1 wherein the wire section dispenser unit dispenses straight wire sections to the stapling heads, and the straight wire sections are bent in a U-shaped staple during their transport to the stapling region.

* * * * *